US006453229B1

(12) United States Patent
Ohkuma et al.

(10) Patent No.: US 6,453,229 B1
(45) Date of Patent: Sep. 17, 2002

(54) AIR-FUEL RATIO CONTROL DEVICE FOR INTERNAL COMBUSTION ENGINE AND METHOD THEREOF

(75) Inventors: Shigeo Ohkuma; Koji Takahashi; Satoru Watanabe; Hajime Hosoya; Hidekazu Yoshizawa; Haruhiro Iwaki, all of Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 110 days.

(21) Appl. No.: 09/691,209

(22) Filed: Oct. 19, 2000

(30) Foreign Application Priority Data

Oct. 19, 1999 (JP) ..... 11-296907
Oct. 19, 1999 (JP) ..... 11-296908
Dec. 14, 1999 (JP) ..... 11-354262

(51) Int. Cl.[7] ..... F02D 41/14; F02D 45/00

(52) U.S. Cl. ..... 701/109; 701/108; 123/696; 123/681

(58) Field of Search ..... 701/109, 108; 123/681, 685, 672, 674, 694, 695, 696

(56) References Cited

U.S. PATENT DOCUMENTS 5,209,206 A * 5/1993 Danno et al. ..... 123/672
5,752,492 A * 5/1998 Kato et al. ..... 123/674
2001/0022176 A1 * 9/2001 Takahashi et al. ..... 123/681
2001/0025635 A1 * 10/2001 Takahashi et al. ..... 123/679
2001/0029936 A1 * 10/2001 Takahashi et al. ..... 123/696

FOREIGN PATENT DOCUMENTS

JP 63-88241 * 4/1988 ..... F02D/41/14
JP 64-80747 * 3/1989 ..... F02D/41/14
JP 8 232713 9/1996 ..... G05B/13/02

* cited by examiner

*Primary Examiner*—John Kwon
*Assistant Examiner*—Hieu T. Vo
(74) *Attorney, Agent, or Firm*—Sughrue Mion, PLLC

(57) ABSTRACT

In an air-fuel ratio feedback control of an internal combustion engine aimed to approximate an air-fuel ratio to a target air-fuel ratio set according to operating conditions of the engine, the feedback control is carried out using the feedback control amount which is computed according to a sliding mode control, having a deviation between the target air-fuel ratio and the detected air-fuel ratio detected by the air-fuel ratio sensor set as a switching function. According to the present invention, a simple air-fuel ratio feedback control is carried out according to an accurate sliding mode control with no dispersion for each engine, that is easy to design, and that can be applied generally to any kind of vehicle or engine. Further, by varying the feedback gain depending on operating conditions, by controlling the computing cycle of the feedback control amount, or by performing a Smith dead time compensation control, the influence provided by the dead time element existing in the control object is eliminated, thereby ensuring the response characteristic and stability of the control system.

35 Claims, 19 Drawing Sheets

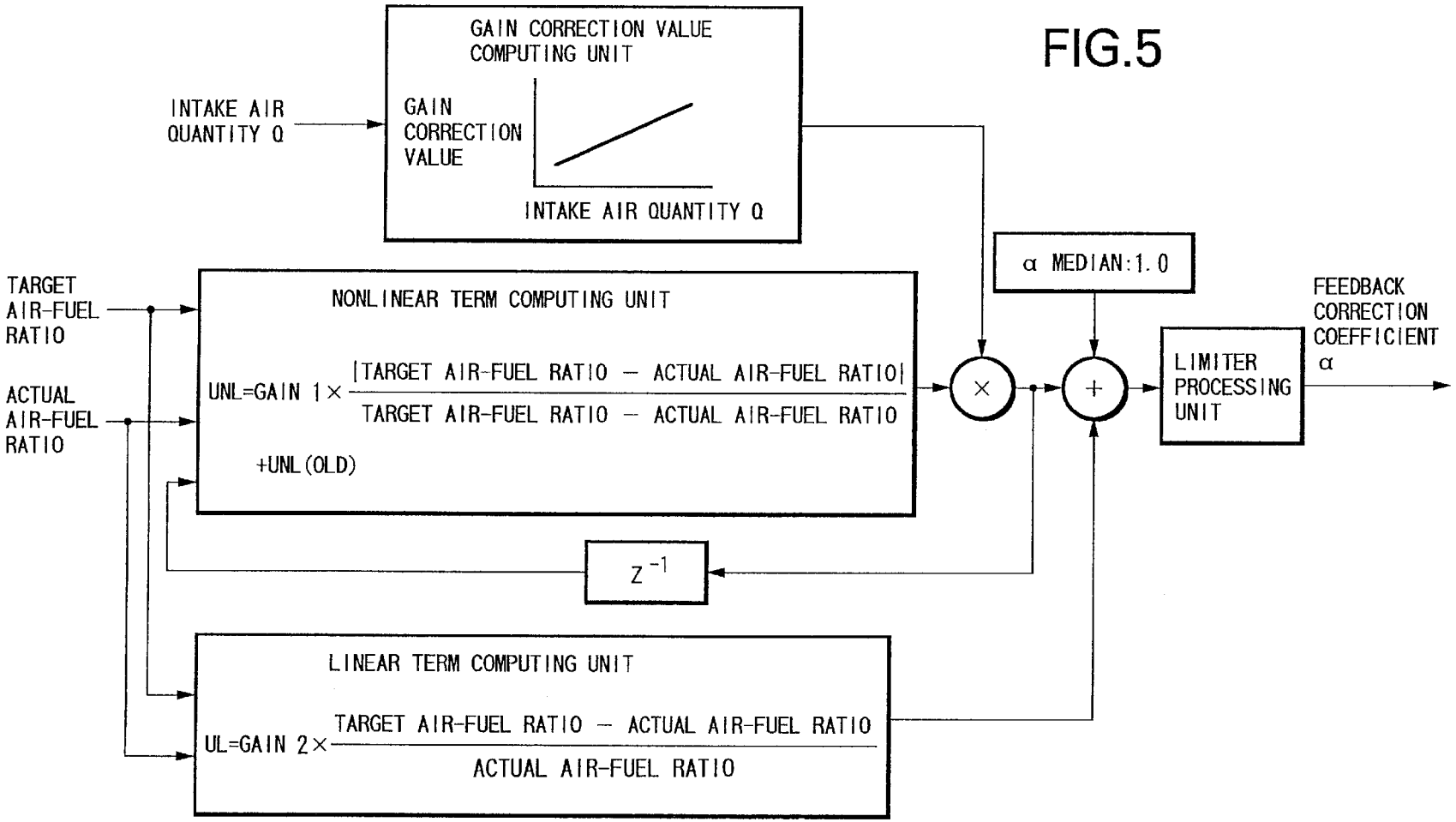
FIG.5
GAIN CORRECTION VALUE COMPUTING UNIT
GAIN CORRECTION VALUE
INTAKE AIR QUANTITY Q
INTAKE AIR QUANTITY Q
NONLINEAR TERM COMPUTING UNIT
UNL=GAIN 1 × |TARGET AIR-FUEL RATIO − ACTUAL AIR-FUEL RATIO| / TARGET AIR-FUEL RATIO − ACTUAL AIR-FUEL RATIO
+UNL (OLD)
α MEDIAN:1.0
LIMITER PROCESSING UNIT
FEEDBACK CORRECTION COEFFICIENT α
Z⁻¹
LINEAR TERM COMPUTING UNIT
UL=GAIN 2 × TARGET AIR-FUEL RATIO − ACTUAL AIR-FUEL RATIO / ACTUAL AIR-FUEL RATIO
TARGET AIR-FUEL RATIO
ACTUAL AIR-FUEL RATIO

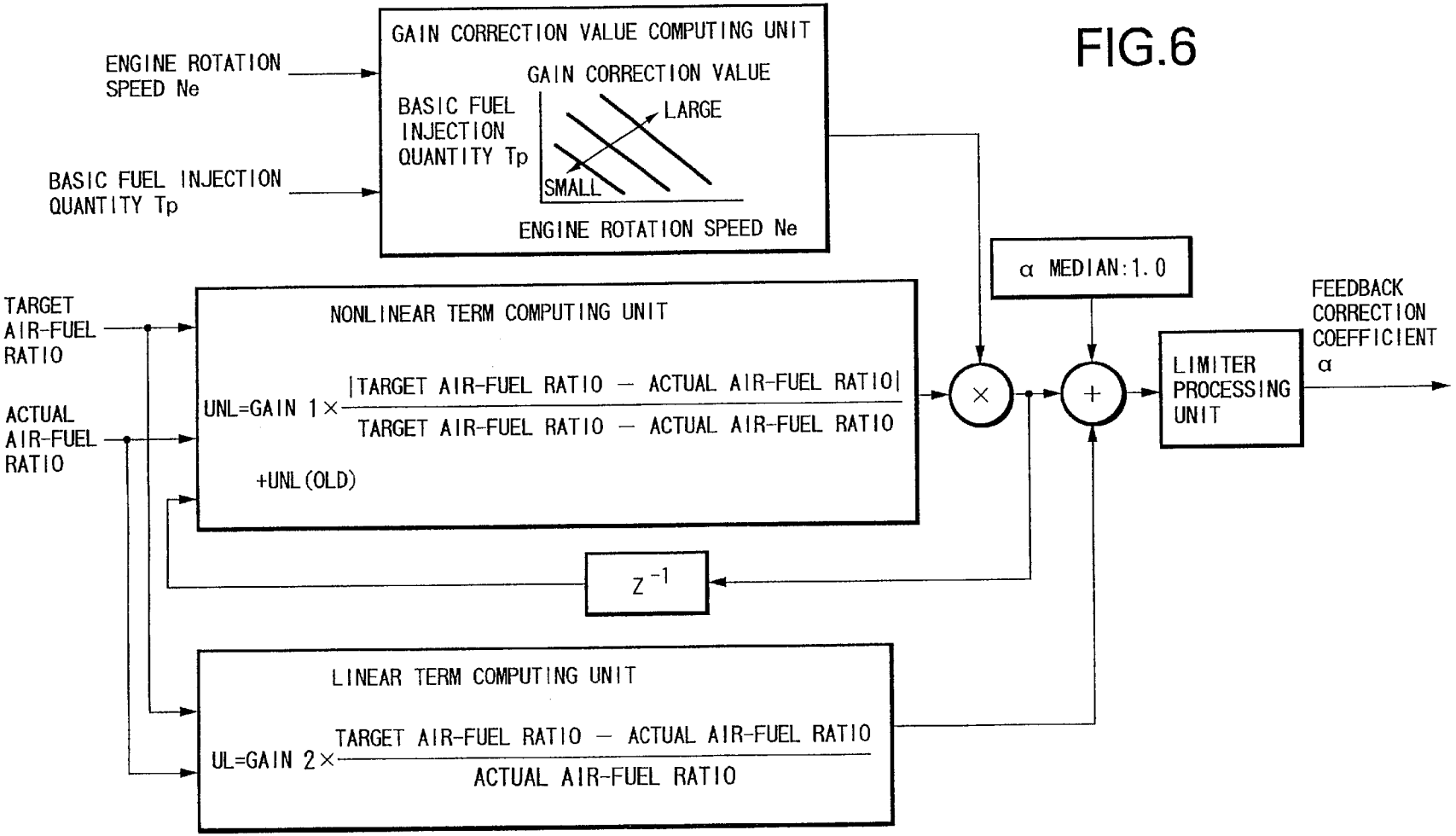
FIG.6
GAIN CORRECTION VALUE COMPUTING UNIT
GAIN CORRECTION VALUE
LARGE
SMALL
BASIC FUEL INJECTION QUANTITY Tp
ENGINE ROTATION SPEED Ne
ENGINE ROTATION SPEED Ne
BASIC FUEL INJECTION QUANTITY Tp
α MEDIAN:1.0
NONLINEAR TERM COMPUTING UNIT
UNL=GAIN 1× |TARGET AIR-FUEL RATIO − ACTUAL AIR-FUEL RATIO| / TARGET AIR-FUEL RATIO − ACTUAL AIR-FUEL RATIO
+UNL(OLD)
Z⁻¹
LINEAR TERM COMPUTING UNIT
UL=GAIN 2× TARGET AIR-FUEL RATIO − ACTUAL AIR-FUEL RATIO / ACTUAL AIR-FUEL RATIO
LIMITER PROCESSING UNIT
FEEDBACK CORRECTION COEFFICIENT α
TARGET AIR-FUEL RATIO
ACTUAL AIR-FUEL RATIO

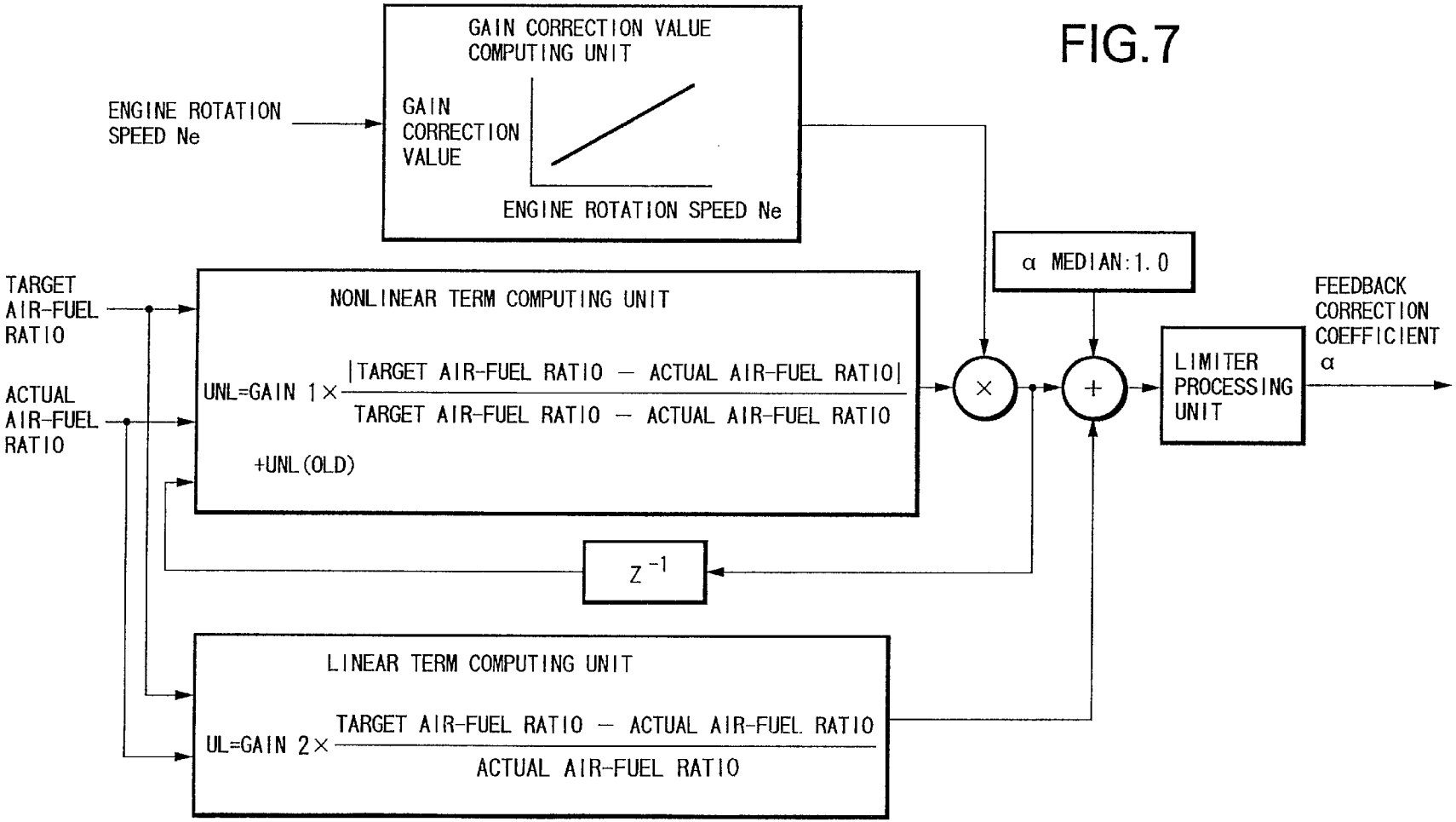
FIG.7
FEEDBACK CORRECTION COEFFICIENT α
LIMITER PROCESSING UNIT
α MEDIAN:1.0
GAIN CORRECTION VALUE COMPUTING UNIT
GAIN CORRECTION VALUE
ENGINE ROTATION SPEED Ne
NONLINEAR TERM COMPUTING UNIT
UNL=GAIN 1×|TARGET AIR-FUEL RATIO − ACTUAL AIR-FUEL RATIO| / TARGET AIR-FUEL RATIO − ACTUAL AIR-FUEL RATIO
+UNL(OLD)
Z⁻¹
LINEAR TERM COMPUTING UNIT
UL=GAIN 2×TARGET AIR-FUEL RATIO − ACTUAL AIR-FUEL RATIO / ACTUAL AIR-FUEL RATIO
ENGINE ROTATION SPEED Ne
TARGET AIR-FUEL RATIO
ACTUAL AIR-FUEL RATIO

AIR-FUEL RATIO CONTROL DEVICE FOR INTERNAL COMBUSTION ENGINE AND METHOD THEREOF

FIELD OF THE INVENTION

The preset invention relates to a device and method for carrying out an air-fuel ratio feedback control of an internal combustion engine, and more specifically, to a technology for carrying out a feedback control using a sliding mode control.

DESCRIPTION OF THE RELATED ART

It is common to carry out a feedback control for an internal combustion engine for vehicle, so as to approximate an air-fuel ratio to a target value, in order to improve the fuel consumption or the exhaust emission.

Therefore, while detecting the air-fuel ratio sequentially by an air-fuel ratio sensor equipped in an exhaust passage and the like, the fuel supply quantity is feedback controlled using PID control (proportional-integral-derivative), in order to converge the detected air-fuel ratio to the target air-fuel ratio.

On the other hand, a sliding mode control is known as a control method having high robust performance with suppressed influence from disturbance, which is often used in controlling robots and the like. A proposal is made to utilize the sliding mode control to the feedback control of the air-fuel ratio (Japanese Unexamined Patent Publication No. 8-232713).

However, the sliding mode control mentioned above used for the feedback control of the air-fuel ratio is not capable of eliminating the influence caused by the dispersion in the part performance for each engine, and therefore, was not highly accurate. This is because in designing the sliding mode control, the air-fuel ratio control system of the engine is modeled considering the response delay and the like of each part.

Moreover, the air-fuel ratio feedback control using the sliding mode control has a general problem. Since the air-fuel ratio is detected through a specific component in the exhaust, dead time, such as transfer delay of the exhaust and the like, exists between the air-fuel ratio detected from the exhaust and the actually controlled air-fuel ratio (fuel supply quantity). During such dead time, excessive compensation is performed. If such dead time is fixed, the computing cycle of the feedback control amount can be set corresponding to such a fixed dead time, to restrain excessive correction. However, the dead time greatly varies according to the operating conditions of the engine, and therefore, it was very difficult to set the computing cycle to an appropriate value. For example, if the computing cycle is set sufficiently large, excessive correction can be restrained, but the response characteristic is reduced. Actually, the computing cycle is set to be small to a certain extent to restrain excessive correction by keeping the feedback gain small. However, this deteriorates the response characteristic, and prevents the sliding mode control from performing its function sufficiently.

Heretofore, the sliding mode control utilized in the air-fuel ratio feedback control involves modeling and designing in detail the delay of various units in the air-fuel ratio control system including the above-mentioned dead time. Therefore, it involved extremely complicated and bothersome processes, could not be used generally for different types of vehicles or engines, and needed large capacity of ROM and RAM for carrying out the complicated control.

SUMMARY OF THE INVENTION

The present invention aims at solving the above mentioned problems. The object of the invention is to provide an air-fuel ratio feedback control using a highly accurate sliding mode control without no dispersion for each engine, that can be carried out easily, that is easy to design, and that can be generally applied to various types of vehicles and engines.

Another object of the invention is to ensure a good response characteristic while restraining excessive correction during dead time in an air-fuel ratio feedback control according to a sliding mode control.

Yet another object of the invention is to eliminate the influence of the dead time element existing in the control object without depending on the later correction of the feedback control amount, thereby ensuring the stability the response characteristic of the control system.

In order to achieve the first common object, the present invention includes the following basic constitution.

An air-fuel ratio is detected linearly by an air-fuel ratio sensor equipped for example in the exhaust passage.

A feedback control amount is computed according to a sliding mode control in which a deviation between a target air-fuel ratio set according to operating conditions of the engine and the detected air-fuel ratio is set as a switching function.

A feedback control is carried out using the computed feedback control amount, so as to approximate the detected air-fuel ratio to the target air-fuel ratio.

According to this constitution, the feedback control of the air-fuel ratio is carried out using the feedback control amount according to the sliding mode control in which the deviation (error) between the target air-fuel ratio and the detected air-fuel ratio (actual air-fuel ratio) is set as a switching function S. Thereby, the air-fuel ratio converges to the target air-fuel ratio while sliding along a switching plane defined as S=0 (in other words, error=0).

Here, the switching function S is set through a method called the direct switching function method of the sliding mode control. This method defines the switching plane (S=0) as a function representing the state to be achieved (in this case, to approximate the air-fuel ratio to the target air-fuel ratio). This method is characterized in that though there is no assurance that the state will slide on the switching plane, once the sliding is confirmed, it enables to provide the best sliding mode control. This is because the switching plane is decided based only on whether the target value is greater or smaller than the actual value, irrespective of a change in response characteristic of a fuel supply device or the air-fuel ratio sensor and the like.

When sliding mode control of the air-fuel ratio is carried out using the switching function set as explained above, it is confirmed that the air-fuel ratio slides along the switching plane.

Therefore, the feedback control according to the sliding mode control can be carried out easily and with high accuracy.

Moreover, unlike the conventional art, the present invention does not involve the complicated process of modeling the engine in order to set the switching function. Therefore, the present invention can be applied generally to different types of vehicle or engine.

Even further, the feedback control amount may include a linear term and a nonlinear term.

According to such a constitution, the feedback control amount computed by the sliding mode control comprises a linear term and a nonlinear term, the linear term adjusting the speed for approximating the state of the control system to the switching plane, and the nonlinear term generating the sliding mode along the switching plane.

Moreover, the linear term may be computed as a value proportional to the ratio between the deviation of the target air-fuel ratio and the detected air-fuel ratio to the detected air-fuel ratio.

According to this constitution, as the air-fuel ratio separates from the switching plane, in proportion to this separation, the linear term is set to a greater value, enabling the air-fuel ratio to approximate the switching plane promptly while suppressing overshooting.

Further, the nonlinear term may be computed by integrating a feedback gain, the positive or negative of which is switched according to whether the switching function is positive or negative.

According to this constitution, the positive or negative of the switching function will reverse whenever the state of the air-fuel ratio crosses the switching plane, and the positive or negative of the feedback gain will also reverse accordingly. By the nonlinear term computed by integrating the feedback gain, the air-fuel ratio promptly converges to the target air-fuel ratio while sliding along the switching plane.

Moreover, the absolute value of the feedback gain may be set to vary according to the operating conditions of the engine.

The delay time until an air-fuel ratio of an intake air being the control object is detected as an air-fuel ratio of the exhaust by an air-fuel ratio detecting means, varies according to the operating conditions of the engine. Therefore, by setting the feedback gain variably according to the operating conditions of the engine, the value of the nonlinear term integrated during the delay time can be fixed. Thus, while the response characteristic is ensured (the response characteristic will be deteriorated if the feedback gain is reduced uniformly), the deviation of the actual air-fuel ratio from the target air-fuel ratio can be appropriately reduced, to realize a stable air-fuel ratio feedback control.

Moreover, the absolute value of the feedback gain may be set to a greater value as an intake air quantity increases.

In this way, since the flow of the exhaust is small when the intake air quantity is small, the time needed for the exhaust from a cylinder to reach the air-fuel ratio detecting means is short, and the contact pressure of the exhaust to the air-fuel ratio detecting means is small. Therefore, the delay time for the air-fuel ratio of the exhaust to be detected is increased. Accordingly, the absolute value of the feedback gain can be set to a greater value as the intake air quantity increases, to fix the value of the nonlinear term integrated during delay time.

Moreover, the absolute value of the feedback gain may be set to increase as the engine rotation speed increases.

When the engine rotation speed is low, the exhaust from the cylinder reaches the air-fuel ratio detecting means in a short time, and so the delay time for the air-fuel ratio of the exhaust to be detected is increased. Therefore, the absolute value of the feedback gain is set to a greater value as the engine rotation speed increases, thereby enabling to fix the value of the nonlinear term integrated during delay time.

Moreover, the air-fuel ratio may be detected by a wide-range air-fuel ratio sensor that detects the air-fuel ratio linearly based on a specific component in the exhaust.

According to this constitution, the wide-range air-fuel ratio sensor can detect the air-fuel ratio highly accurately, which leads to carrying out a highly accurate air-fuel ratio feedback control according to the sliding mode control.

Alternatively, the air-fuel ratio may be detected by a narrow-range air-fuel ratio sensor that detects the rich/lean of the air-fuel ratio in an on/off manner based on a specific component in the exhaust, and the value detected by the narrow-range air-fuel ratio sensor is linearized and then utilized as the detection value of the air-fuel ratio to compute the feedback control amount.

According to such a constitution, even when a narrow-range air-fuel ratio sensor detecting the rich/lean of the air-fuel ratio in an on/off manner is utilized by linearizing the value detected by the narrow-range air-fuel ratio sensor, the linearized air-fuel ratio detected value can be used to perform the air-fuel ratio feedback control using the sliding mode control according to the present invention.

Next, the present invention for achieving the second object, in which by the computing cycle of the feedback control amount, high response characteristic is ensured while restraining excessive correction during dead time, includes the following constitution in addition to the basic invention.

That is, the computing cycle is controlled so that the feedback control amount according to the sliding mode control is computed in synchronism with the stroke cycle of the engine.

As mentioned, the dead time for the exhaust discharged from the combustion chamber of each cylinder to reach the air-fuel ratio detecting means changes greatly depending on operating conditions. However, if the dead time is converted to the number of strokes of the engine, most is fixed without much deviation. In other words, the exhaust discharged from a combustion chamber during the exhaust stroke of one cylinder is presumed to reach the air-fuel ratio detecting means during a plural number of times of the exhaust stroke of other cylinders. Therefore, by controlling the computing cycle so that the feedback control amount of the sliding mode control is computed in synchronism with the stroke cycle of the engine, the number of times of computing during dead time is withheld to below a fixed value or below, and excessive correction can be restrained. Moreover, as a result, the feedback gain could be increased sufficiently, leading to high response characteristic.

The computing cycle for the feedback control amount may be controlled to correspond to a multiplicative value of the stroke cycle of the engine.

Most simply, even if the feedback control amount can be computed per one stroke cycle of the engine, the excessive correction can be restrained to a certain number of times of the stroke cycles or below. However, excessive correction could be further restrained if the computing cycle corresponds to a multiplicative of the dead time converted into the number of stroke cycles.

Further, the computing cycle of the feedback control amount may be variably controlled according to the operating conditions of the engine.

Though the value obtained by converting the dead time with the number of stroke cycles is mostly fixed, it may be considered to vary according to operating conditions. Therefore, the computing cycle of the feedback control amount is controlled variably according to the operating conditions of the engine, resulting in more accurate control.

For example, when considering how many times of exhaust discharged from each cylinder are required in order to fill the capacity of the exhaust passage from the combustion chamber to the air-fuel ratio detecting means (sensor), it depends on the amount of exhaust for each cylinder. Therefore, by variably controlling the computing cycle, that is a multiplicative of the stroke cycle, through a value representing the amount of exhaust, such as a basic fuel injection quantity Tp and the like, a more accurate control can be carried out.

Moreover, the computing cycle of the feedback control amount may be variably controlled according to the deviation between the target air-fuel ratio and the actual air-fuel ratio detected by the air-fuel ratio detecting means.

According to this constitution, when the deviation is large, the computing cycle, which is the multiplicative of the stroke cycle, is reduced by making much of the response characteristic (reduce the multiplicative value), and at the time when the deviation is reduced, the computing cycle is increased to a cycle (multiplicative of the stroke cycle) corresponding to the dead time, so as to carry out the control with the reduced deviation from the target air-fuel ratio.

Even further, the computing cycle may be controlled so that the feedback control amount is computed in synchronism with a signal detecting a predetermined stroke timing of each cylinder.

According to this constitution, the feedback control amount is computed in synchronism with the signal detecting the predetermined stroke timing of each cylinder, so that the computing cycle can be easily synchronized with the stroke cycle of the engine.

Moreover, a reference signal output from a crank angle sensor for detecting the rotation speed or determining the cylinders at a predetermined stroke timing of each cylinder may be used as the signal detecting the predetermined stroke timing of each cylinder. Therefore, the computing timing of the feedback control amount can easily be controlled.

Alternatively, a detection signal detecting the inner-cylinder pressure used for detecting knocking and the like may be used as the predetermined stroke timing of each cylinder. The predetermined stroke timing can be detected for example by using the fact that the inner-cylinder pressure increases at the top dead center of compression.

Next, the preset invention for achieving the third object, in which the influence of the dead time element existing in the control object can be eliminated without depending on the later correction of the feedback control amount, thereby ensuring the stability and the response characteristic of the control system, is realized by the following constitution.

The air-fuel ratio is detected linearly by an air-fuel ratio sensor and the like provided in the exhaust passage.

The phase delay caused by a dead time element of the control object included in the detected air-fuel ratio is compensated for using a model of the control object represented by a transfer function that is switched according to the operating conditions of the engine.

The feedback control amount is computed using the detected air-fuel ratio whose phase delay has been compensated for, based on a sliding mode control in which the deviation between the target air-fuel ratio and the actual air-fuel ratio detected by the air-fuel ration detecting means is set as a switching function.

According to such constitution, the phase delay of the air-fuel ratio detected by the air-fuel ratio sensor is compensated for before the feedback control amount is computed. Thus, the feedback control amount is computed based on the detected air-fuel ratio after being compensated for its delay. Moreover, since the transfer function representing the control object model can be switched depending on the operating conditions of the engine, a model corresponding to every operating condition of the engine can be used to correspond to the various properties of the control object, such as the filling of the gas to the cylinder, the adhesion of the fuel from the fuel supply device to the wall surface of the intake pipe, and the transfer of the exhaust.

In this way, the feedback control amount can be computed to become most suitably when eliminating the influence of the dead time element existing in the control object. Thus, a large feedback control amount can be output throughout the whole region of the engine operating condition while maintaining the stability of the control system, and therefore, a good response characteristic of the control system can be ensured. Even further, since a model corresponding to the property of the control object is used, the phase delay of the detected air-fuel ratio can be accurately compensated for without depending on the change of property of the control object, thereby improving the robustness of the control system.

Moreover, the model of the control object may be composed of a first element that does not include the dead time element, and a second element that represents the dead time element.

According to such constitution, the influence of the dead time element existing in the control object is eliminated using the model representing the second element.

The feedback control amount is computed based on the control object eliminated of such dead time element, or ideally, an output that passed through only the transfer function representing the first element.

In this way, the phase delay of the detected air-fuel ratio can easily be compensated for using the second element, and the feedback control amount can be computed easily based on the information that does not include any phase delay.

Further, a Smith dead time compensation control (proposed by Otto Smith) may be used to compensate for the phase delay included in the detected air-fuel ratio.

According to this constitution, the influence of the dead time element existing in the control object is apparently excluded from the feedback group using the model representing the second element. The feedback control amount is computed based on the output obtained from prior to the excluded dead time element, or ideally, the output that passed through only the transfer function representing the first element.

Thus, the phase delay of the detected air-fuel ratio is compensated easily, and the air-fuel ratio feedback control is carried out by a more simple control system.

Moreover, in the transfer function representing the model of the control object, the order of the transfer function representing the first element may be varied and switched. In other words, the order of the transfer function representing the first element, or the formula of the transfer function itself, may be switched, so as to correspond to the change (increase and decrease) in the variety of response delay elements causing the response delay of the control object, such as the delay in the filling of gas in the cylinder or the adhesion of the fuel from the fuel supply device to the wall surface of the intake pipe.

Thereby, the phase delay of the detected air-fuel ratio can be correctly compensated without depending on the change in the variety of response delay elements existing in the control object, and at the same time, the present constitution can contribute to a more accurate computing of the feedback control amount.

Moreover, in the transfer function representing the model of the control object, the time constant of the transfer function representing the first element may be varied and switched. In other words, the time constant of the transfer function representing the first element may be able to change in order to correspond to the change in property of the response delay element existing in the control object.

Thereby, the phase delay of the detected air-fuel ratio could be compensated accurately without depending on the change of property of the response delay element existing in the control object, and therefore, the present constitution can contribute to a more accurate computing of the feedback control amount.

Even further, in the transfer function representing the model of the control object, the dead time of the transfer function representing the second element may be varied and switched. In other words, the dead time of the transfer function representing the second element may be able to change in order to correspond to the change in property of the dead time element existing in the control object, especially the change in dead time caused by the transfer delay of the exhaust.

According to this constitution, the phase delay of the detected air-fuel ratio can be compensated accurately without depending on the dead time element existing in the control object, especially the change in dead time caused by the transfer delay of the exhaust.

Even further, the transfer function may be switched according to the acceleration or deceleration of the engine.

According to this constitution, the control object model can be switched according to the change in property of the control object caused by the acceleration or deceleration of the engine.

Thereby, the transfer function representing the control object model, and further the control object model itself, can be easily switched according to the change in the property of the control object based on the acceleration or deceleration of the engine, and the best control object model corresponding to the property of the control object can be used.

Even further, the transfer function may be switched according to the intake air quantity.

According to this constitution, the control object model can be switched according to the change in property of the control object caused by the change in the intake air quantity.

Thereby, the transfer function representing the control object model, and further the control object model itself, can be easily switched according to the change in the property of the control object based on the intake air quantity, and the best control object model corresponding to the property of the control object can be used.

Even further, the transfer function may be switched according to the wall temperature of the intake pipe.

According to this constitution, the control object model can be switched according to the change in property of the control object caused by the change in the intake pipe wall temperature.

Thereby, the transfer function representing the control object model, and further the control object model itself, can be easily switched according to the change in property of the control object based on the intake pipe wall temperature, and the best control object model corresponding to the property of the control object can be used.

The other objects and features of this invention will become understood from the following description with reference to accompanying drawings.

BRIEF EXPLANATION OF THE DRAWINGS

FIG. 5 is a control block diagram of a second embodiment;

FIG. 6 is a control block diagram of a third embodiment;

FIG. 7 is a control block diagram of a fourth embodiment;

DETAILED DESCRIPTION OF THE PREFERRED EMBODIMENT

Embodiments of the present invention will now be explained with reference to the drawings.

Figure 1:
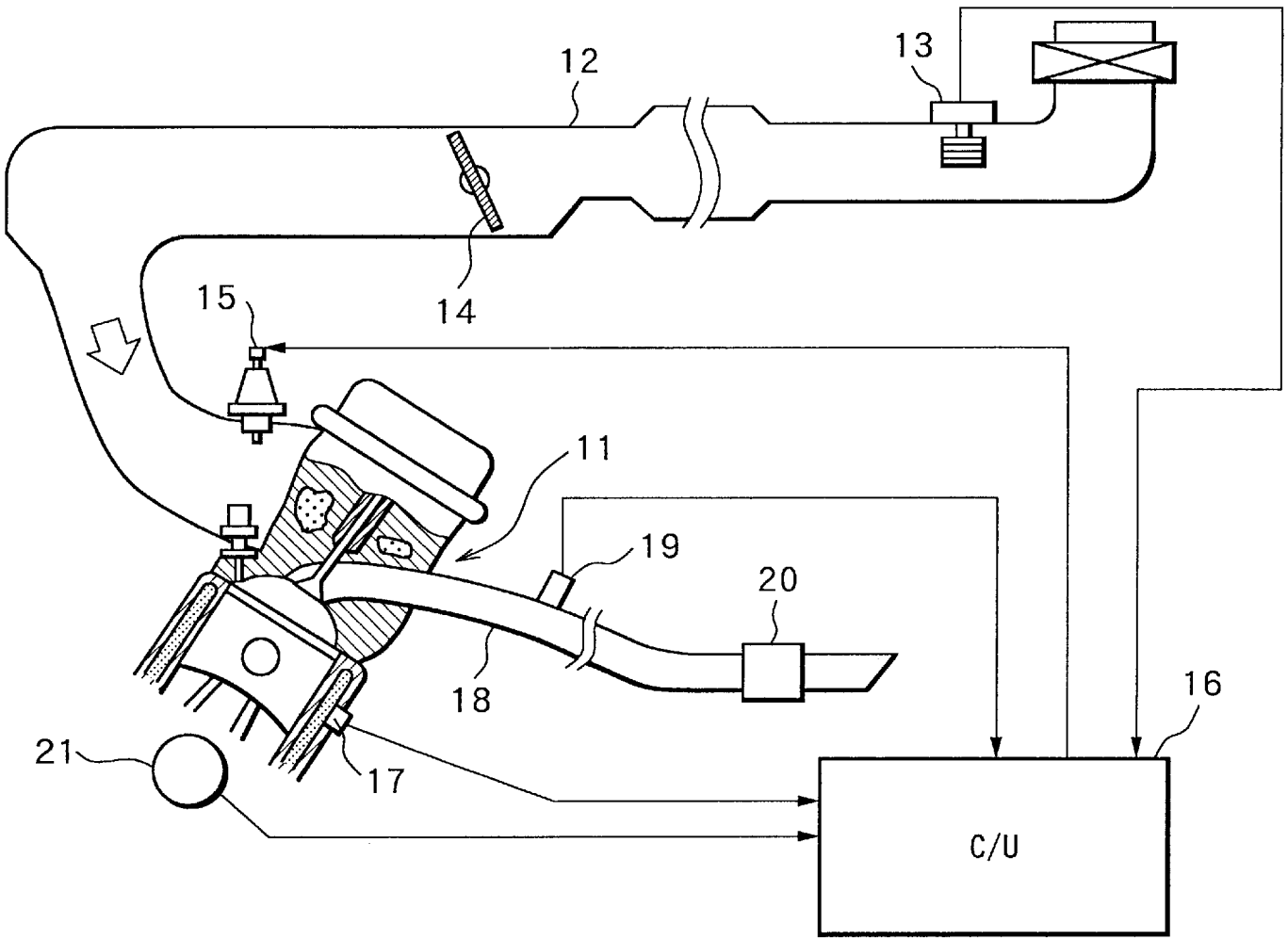
FIG. 1 is a view showing the system structure of an embodiment according to the present invention.

According to FIG. 1 showing the system composition of the present embodiment, an airflow meter 13 for detecting an intake airflow quantity Qa and a throttle valve 14 for controlling the intake airflow quantity Qa by interlocking with an accelerator pedal are provided in an intake passage 12 of an engine 11. An electromagnetic fuel injection valve 15 is mounted to the manifold portion placed on the downstream side of the passage 12 for each cylinder, serving as a fuel supply device.

The fuel injection valve 15 is driven to open by an injection pulse signal provided from a control unit 16 installing a microcomputer, to injectingly supply fuel which has been sent under pressure from a fuel pump (not shown) and controlled to a predetermined pressure by a pressure regulator. Moreover, a water temperature sensor 17 for detecting the cooling water temperature Tw within the cooling jacket of the engine 11 is provided. Even further, a wide-range air-fuel ratio sensor 19 is equipped for detecting an air-fuel ratio of the intake mixture linearly according to the oxygen concentration in the exhaust within an exhaust passage 18. Moreover, a ternary catalyst 20 is equipped for purifying the exhaust by oxidizing CO and HC and reducing NOx in the exhaust at the downstreatm side.

The structure of the wide-range air-fuel ratio sensor 19 will now be explained based on FIG. 2.

A positive electrode 32 for measuring oxygen concentration is provided on a substrate 31 formed of a solid-electrolyte member such as zirconia (ZrO2) and the like. Further, an atmosphere inlet hole 33 is formed on the substrate 31 for introducing atmosphere thereto. A negative electrode 34 is mounted on the inlet hole 33 opposing to the positive electrode 32.

The substrate 31, the positive electrode 32 and the negative electrode 34 constitute an oxygen concentration detecting unit 35.

Moreover, on both sides of the solid-electrolyte member 36 made for example of zirconia is provided a pair of pump electrodes 37 and 38 formed of platinum, which constitutes an oxygen pump unit 39.

The oxygen pump unit 39 is laminated above the oxygen concentration detecting unit 35 via a frame-shaped spacer 40 made for example of alumina. Thereby, a sealed hollow chamber 41 is formed between the oxygen concentration detecting unit 35 and the oxygen pump unit 39. Further, an inlet hole 42 for introducing the exhaust of the engine into the hollow chamber 41 is formed on the solid-electrolyte member 36 of the oxygen pump unit 39. Moreover, an adhesive 43 made of glass fills the outer peripheral of the spacer 40, which ensures the seal of the hollow chamber 41, and adheres and fixes the spacer 40 and the solid-electrolyte member 36 to the substrate 31. Since the spacer 40 and the substrate 31 are simultaneously fired and bonded together, the seal of the hollow chamber 41 is ensured by bonding the spacer 40 and the solid-electrolyte member 36. A heater 44 for warm-up is installed to the oxygen concentration detecting unit 35.

The oxygen concentration of the exhaust introduced to the hollow chamber 41 through the inlet hole 42 is detected based on the voltage of the positive electrode 32. Actually, according to the difference in concentration between the oxygen in the atmosphere within the atmosphere inlet hole 33 and the oxygen in the exhaust within the hollow chamber 41, oxygen ion current flows through the substrate 31. Accompanied by the flow, a voltage is generated to the positive electrode 32 corresponding to the oxygen concentration of the exhaust.

Then, according to the result of detection, the current vale flown to the oxygen pump unit 39 is variably controlled so as to maintain the atmosphere within the hollow chamber 41 to be constant (for example, to a theoretical air-fuel ratio). Based on the current value at that time, the oxygen concentration of the exhaust can be detected.

Actually, after amplifying the voltage of the positive electrode 32 by a control circuit 45, the voltage is applied between the electrodes 37 and 38 through a voltage detection resistor 46, so as to maintain the oxygen concentration within the hollow chamber 41 to be constant.

When detecting the air-fuel ratio in the lean region where the oxygen concentration in the exhaust is high, the outside pump electrode 37 is made positive, and the pump electrode 38 inside the hollow chamber 41 is made negative, to apply a voltage between the electrodes. As a result, the oxygen (oxygen ion $O^{2-}$) proportional to the current is pumped out from the hollow chamber 41. When the applied voltage reaches a predetermined value or above, the flowing current reaches a limit value. By measuring the limit current value by the control circuit 45, the oxygen concentration in the exhaust, in other words, the air-fuel ratio, can be detected.

In contrast, by pumping oxygen into the hollow chamber 41 while the pump electrode 37 is made negative and the pump electrode 38 is made positive, the air-fuel ratio in the rich region can be detected, wherein the oxygen concentration of the exhaust is low.

The above-mentioned limit current is detected based on the voltage output of a differential amplifier 47 that detects the voltage between terminals of the voltage detecting resistor 46.

Returning to FIG. 1, a crank angle sensor 21 is installed in a distributor not shown. The engine rotation speed Ne is detected either by counting the crank unit angle signals output from the crank angle sensor 21 in synchronism with the engine rotation for a fixed time, or by measuring the cycle of the crank reference angle signals.

The control unit 16 computes and controls a fuel injection quantity or an ignition timing of the fuel injection valve 15. Here, in the feedback control region of the air-fuel ratio, the fuel injection quantity is computed so that the air-fuel ratio feedback control is performed according to the sliding mode control of the present invention.

Figure 3:
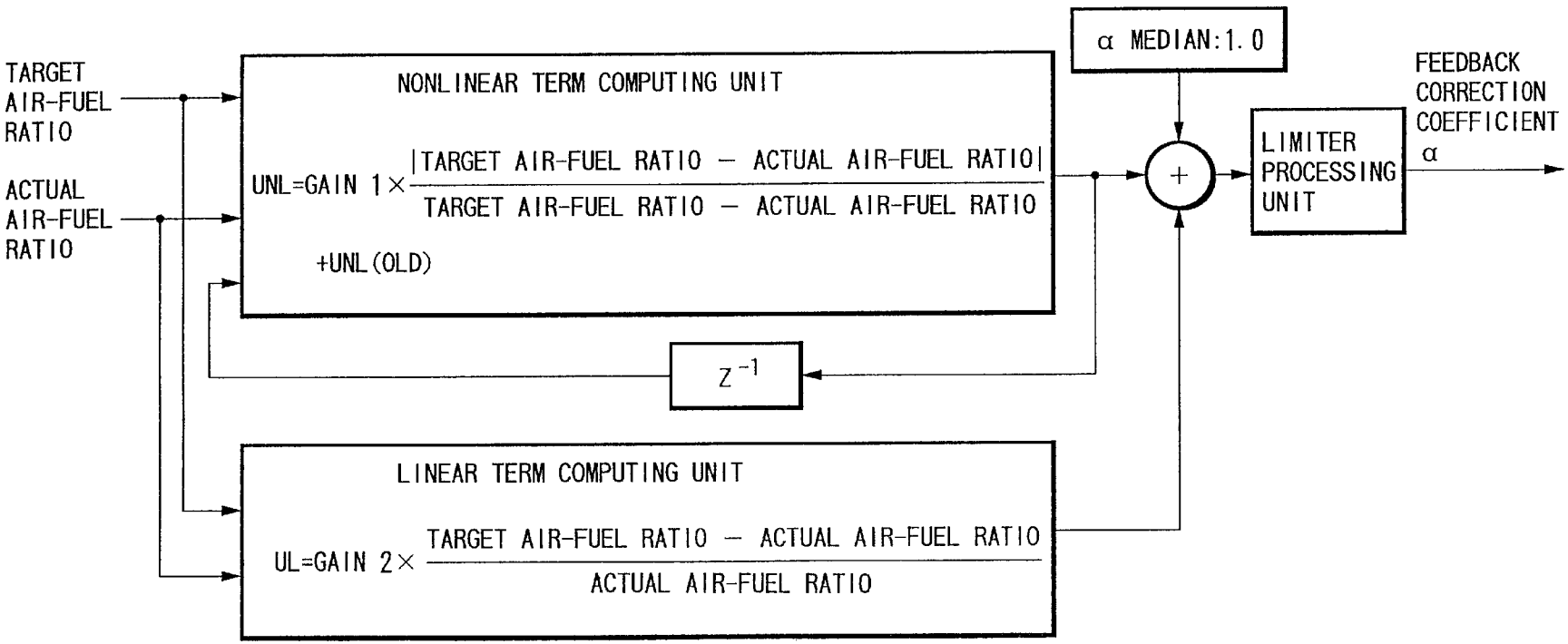
FIG. 3 is a control block diagram of a first embodiment.

The outline of a first embodiment of the air-fuel ratio feedback control according to the sliding mode control is explained now with reference to FIG. 3 (control block diagram).

In a nonlinear term arithmetic unit, the nonlinear term $U_{NL}$ of the feedback control amount is computed as follows:

$$U_{NL}=(\text{gain 1})\cdot|\text{target air-fuel ratio}-\text{actual air-fuel ratio}|/(\text{target air-fuel ratio}-\text{actual air-fuel ratio})+U_{NL(OLD)}$$

In other words, according to the sliding mode control, a direct switching function method is used to set the switching function S to switching function method S=target air-fuel ratio−actual air-fuel ratio. Thereby, the switching plane S=0 becomes the desired status, actual air-fuel ratio=target air fuel ratio, and each time the switching plane is crossed, the direction of increase or decrease (positive or negative) of the feedback gain is switched. The nonlinear term $U_{NL}$ is computed as a value obtained by integrating the feedback gain, in which the direction of increase or decrease (positive or negative) is thus switched at the switching plane.

Moreover, in a linear term computing unit, the linear term $U_L$ of the feedback control amount is computed by the following:

$$U_L=(\text{gain 2})\cdot(\text{target air-fuel ratio}-\text{actual air-fuel ratio})/\text{actual air-fuel ratio}.$$

The linear term $U_L$ is set so as to adjust the speed for the status to approach the switching plane when the target air-fuel ratio is switched greatly. That is, the linear term is set to a greater value when the deviation (=target air-fuel ratio−actual air-fuel ratio) is greater, and decreases to a smaller value as the status approaches the switching plane promptly, thereby functioning to prevent an overshoot.

The value obtained by adding the linear term control amount $U_L$ and the nonlinear term control amount $U_{NL}$ is added to the median (value corresponding to no feedback correction: 1.0) of a feedback correction coefficient $\alpha$ of the air-fuel ratio, to output after being processed at a limiter process unit, so as to be the value equal to or below an upper limit value and equal to or above a lower limit value.

Thereafter, similar to the conventional air-fuel ratio control, a basic fuel injection quantity Tp computed based on the intake air quantity and the engine rotation speed is corrected by various correction coefficients COEF such as water temperature and the like. Then, the obtained value is multiplied by the feedback correction coefficient $\alpha$ computed as above, and a battery voltage correction Ts is added to the multiplied value, to compute the fuel injection quantity (fuel injection pulse width) Ti. Then, a drive signal (pulse) is output to the fuel injection valve 15, thereby injecting the corresponding amount of fuel.

Thus, it is confirmed that the switching function S is set by the direct switching function method according to the sliding mode control, and the switching plane (S=0) is set to the desired status in which the air-fuel ratio is equal to the target air-fuel ratio, and at the same time, the air-fuel ratio converges to the target air-fuel ratio while sliding on the switching plane.

Therefore, compared to the conventional sliding mode control of the air-fuel ratio where the engine is modeled to set the switching function, the sliding mode control of the present embodiment realizes a highly accurate feedback control without being influenced by the dispersion for each engine.

Moreover, the present sliding mode control is free from the bothersome and complicated work of modeling the engine, and is not influenced by the dispersion of the various types of vehicles or engines (no need of any adjustment), and is good for general use.

Now, the present control is compared to the conventional PID control. According to the PID control, if there is a change in the response characteristic of the air-fuel ratio sensor with time lapse or dispersion of members, though the relation between the target air-fuel ratio and the actual air-fuel ratio is correct, the deviation (error quantity) can not be computed correctly. In such a case, the PID control is effected by the erroneous calculation, and provides improper control, such as delay in converging to the target air-fuel ratio. In comparison, according to the control of the present embodiment, the control is performed using the nonlinear term computed irrespective of the value of deviation based on only the determination of which value is greater, the target air-fuel ratio or the actual air-fuel ratio. Accordingly, a stable control can be carried out without any influence from a change in response characteristic of the air-fuel ratio sensor with time lapse or dispersion of members.

The second embodiment will now be explained.

Figure 4:
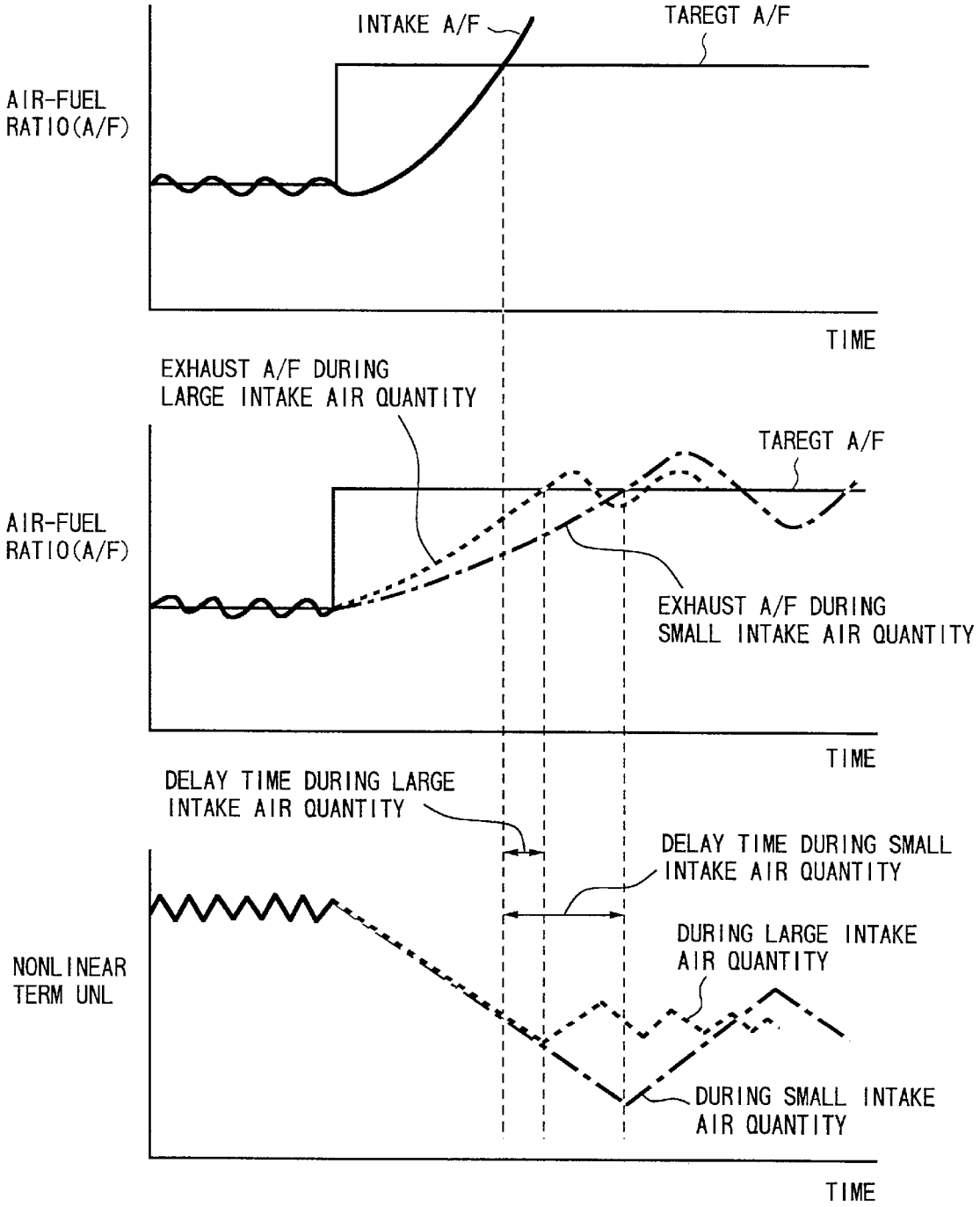
FIG. 4 is a time chart showing the influence on the nonlinear term by the delay time of the detection of air-fuel ratio.

According to the sliding mode control of the present invention, an ideal control can be carried out if the air-fuel ratio of the mixture provided to the combustion chamber for combustion is directly detected. Actually, however, there is a time delay until the exhaust discharged from the combustion chamber reaches the air-fuel ratio sensor to be detected. During this delay, the nonlinear term is corrected excessively (refer to FIG. 4).

In this case, as shown in the first embodiment, if gain 1 of the nonlinear term $U_{NL}$ is a fixed value, since the delay time varies depending on the operating conditions, the excessive correction amount of the nonlinear term $U_{NL}$ computed during this time becomes great when the delay time is long. However, if gain 1 is set to a smaller value so as to reduce the excessive correction amount, the response characteristic is deteriorated (the approach to the switching plane is delayed).

Therefore, according to the second embodiment, gain 1 is variably set depending on the operating conditions.

Actually, when the intake air quantity Q detected by the airflow meter 13 is small, the flow of exhaust is small, the time for the exhaust from the cylinder to reach the air-fuel ratio sensor 15 is short, and the contact pressure of the exhaust to the air-fuel ratio sensor 15 is small. Therefore, the delay time for the air-fuel ratio of the exhaust to be detected becomes longer. Accordingly, the absolute value of gain 1 is set to be corrected by a correction value, so that when the intake air quantity Q is small, the absolute value is corrected to a small value, and when the intake air quantity Q is large, the absolute value is corrected to a large value. In this way, the excessive correction amount of the nonlinear term $U_{NL}$ computed during delay time can be set to be constant, the response characteristic is ensured, and the deviation of the actual air-fuel ratio from the target air-fuel ratio is moderately reduced, thereby realizing a stable sliding mode control with minimum influence from a change in operating conditions.

The outline of the second embodiment is shown in FIG. 5 (control block diagram).

Further, the absolute value of gain 1 of the nonlinear term $U_{NL}$ may be corrected by a correction value set by a map table in which the engine rotation speed Ne and the load (such as the basic fuel injection quantity Tp) are set as parameters, instead of the intake air quantity Q. This is shown in FIG. 6 (control block diagram) as the outline of a third embodiment.

When the engine rotation speed Ne is slow, the flow speed of the exhaust from the cylinder is small and a time needed for the exhaust to reach the air-fuel ratio sensor 15 is short, so the delay time for the air-fuel ratio of the exhaust to be detected is increased. Therefore, the value of the nonlinear term $U_{NL}$ integrated during delay time can be set to be constant simply by setting the absolute value of gain 1 of the nonlinear term $U_{NL}$ to be corrected by a correction value to a smaller value when the engine rotation speed Ne is low and to a greater value when the speed Ne is high. This is shown in FIG. 7 (control block diagram) as the outline of embodiment 4.

Figure 2:
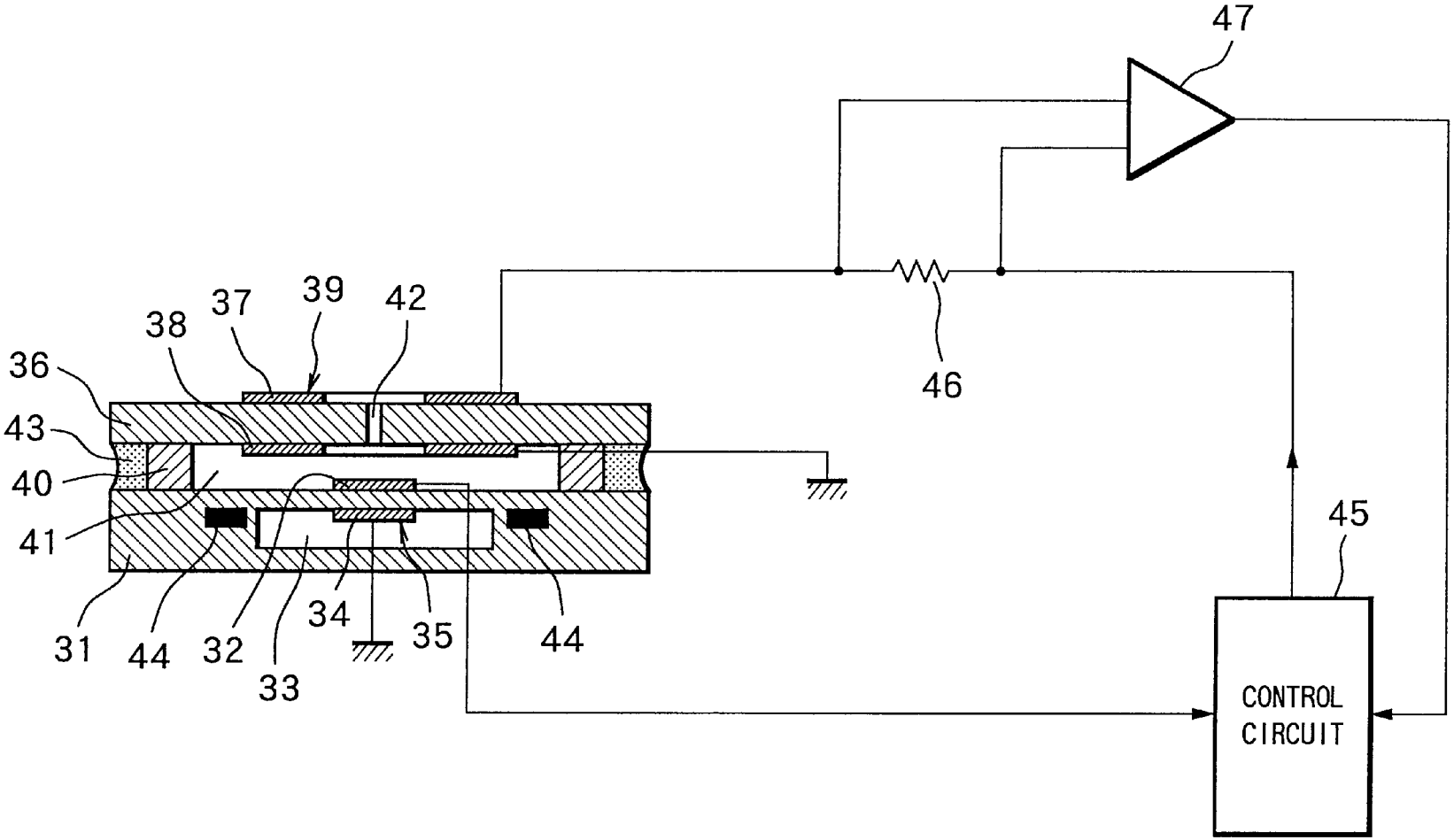
FIG. 2 is a view showing the air-fuel ratio sensor and the peripheral circuit of the sensor according to the embodiment of FIG. 1.
Figure 8:
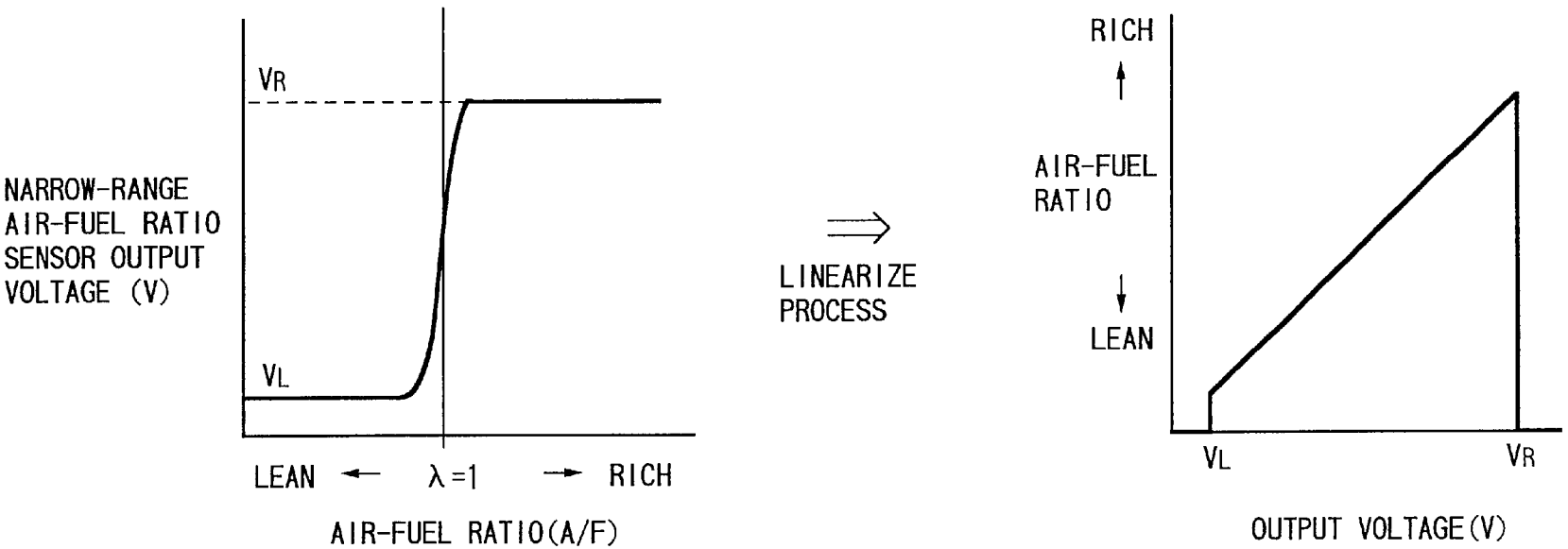
FIG. 8 shows the state where the linearizing process is performed to the detected value of a narrow-range air-fuel ratio sensor.

Further, when a wide-range air-fuel ratio sensor as shown in FIG. 2 is used as a detecting means for detecting the air-fuel ratio linearly, the air-fuel ratio could be detected highly accurately. However, when there is used a narrow-range air-fuel ratio sensor (general oxygen sensor) where the air-fuel ratio is detected in an on/off manner, the present embodiment can be applied if a linearizing process as shown in FIG. 8 is applied to the detected value.

Next, the other embodiments (fifth to seventh embodiments) according to the invention is explained, in which high response characteristic can be ensured while restraining excessive correction during dead time, by controlling the computing cycle of the feedback control amount.

The structures of the system and the air-fuel ratio sensor are the same as those of FIGS. 1 and 2, and the basic control is similar to that shown in FIG. 3. However, the control of the computing cycle of the feedback control amount shown by $Z^{-1}$ in FIG. 3 is mainly related to the present invention.

Figure 9:
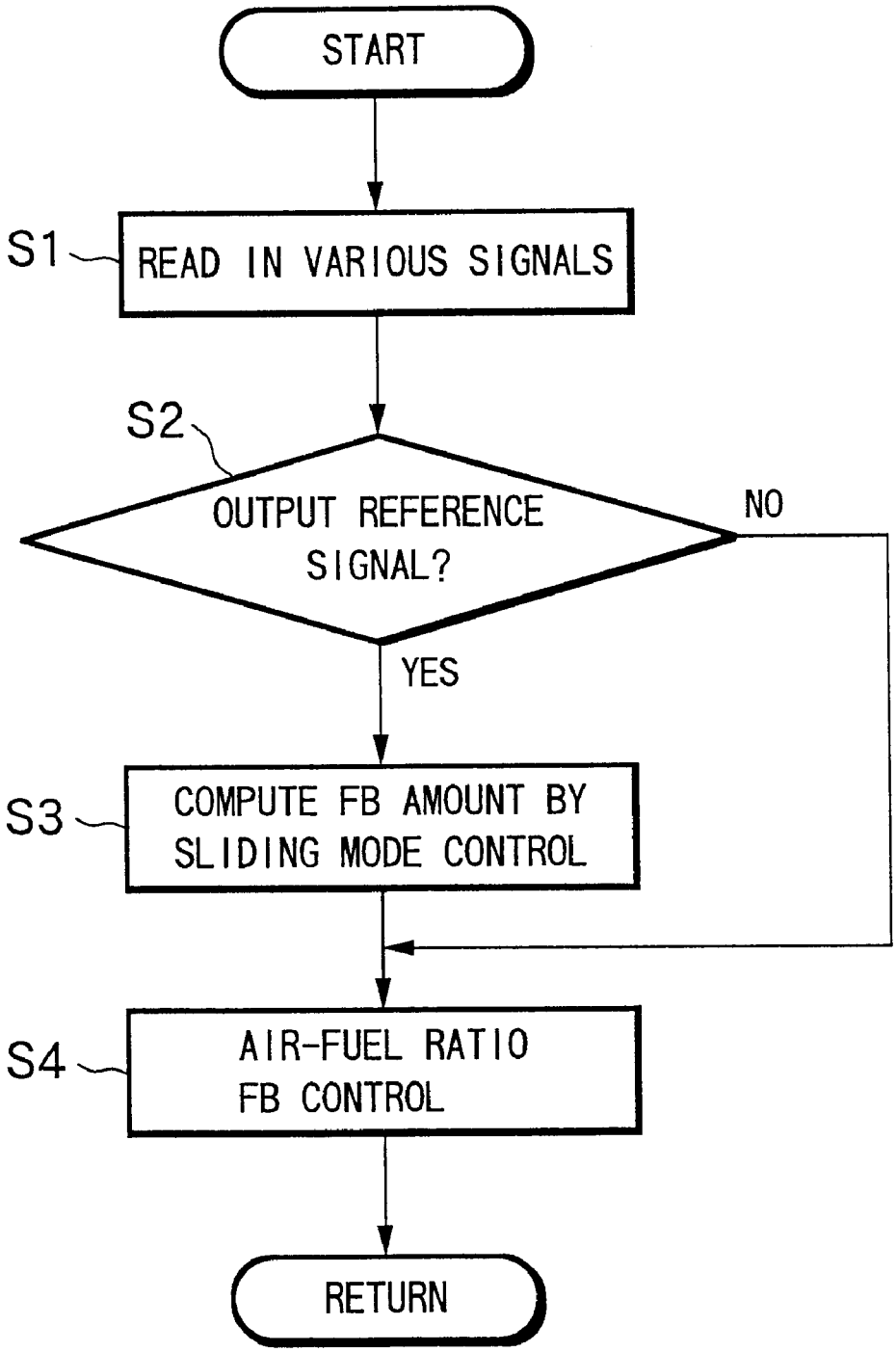
FIG. 9 is a flowchart showing the air-fuel ratio feedback control routine of a fifth embodiment.

The fifth embodiment of the invention is explained according to the flowchart of FIG. 9, wherein the air-fuel ratio feedback control by the sliding mode control is performed according to a predetermined cycle.

In step 1, various signals to be used in the air-fuel ratio feedback control by the sliding mode control is read in.

In step 2, determination is made on whether or not a reference signal has been output from the crank angle sensor. The reference signal is, for example, output near the top dead center of exhaust of each cylinder. In such a case, the time of reference signal output means the termination of exhaust stroke of the corresponding cylinder.

When the reference signal is determined to be output, the procedure is advanced to step 3, wherein according to the sliding mode control, the feedback control amount is computed (feedback correction coefficient $\alpha$).

In step 4, the air-fuel ratio feedback control is performed by computing the fuel injection quantity as mentioned using the feedback correction amount that is computed and updated every cycle, and outputting the computed fuel injection quantity at a predetermined fuel injection timing.

The present embodiment shows the simplest control. For example, if the exhaust discharged from the combustion chamber of a certain cylinder reaches the air-fuel ratio sensor in a time corresponding to three discharge strokes, the feedback control amount is computed and updated every stroke cycle, so the excessive correction amount can be withheld to twice the gain 1 of the nonlinear term. Moreover, since much of the excessive correction amount can be estimated in advance, the value of gain 1 can be set accordingly. Thereby, the sliding mode control with smaller deviation from the target air-fuel ratio can be realized. As a result, the feedback gain can be enlarged, and high response characteristic can be ensured.

Figure 10:
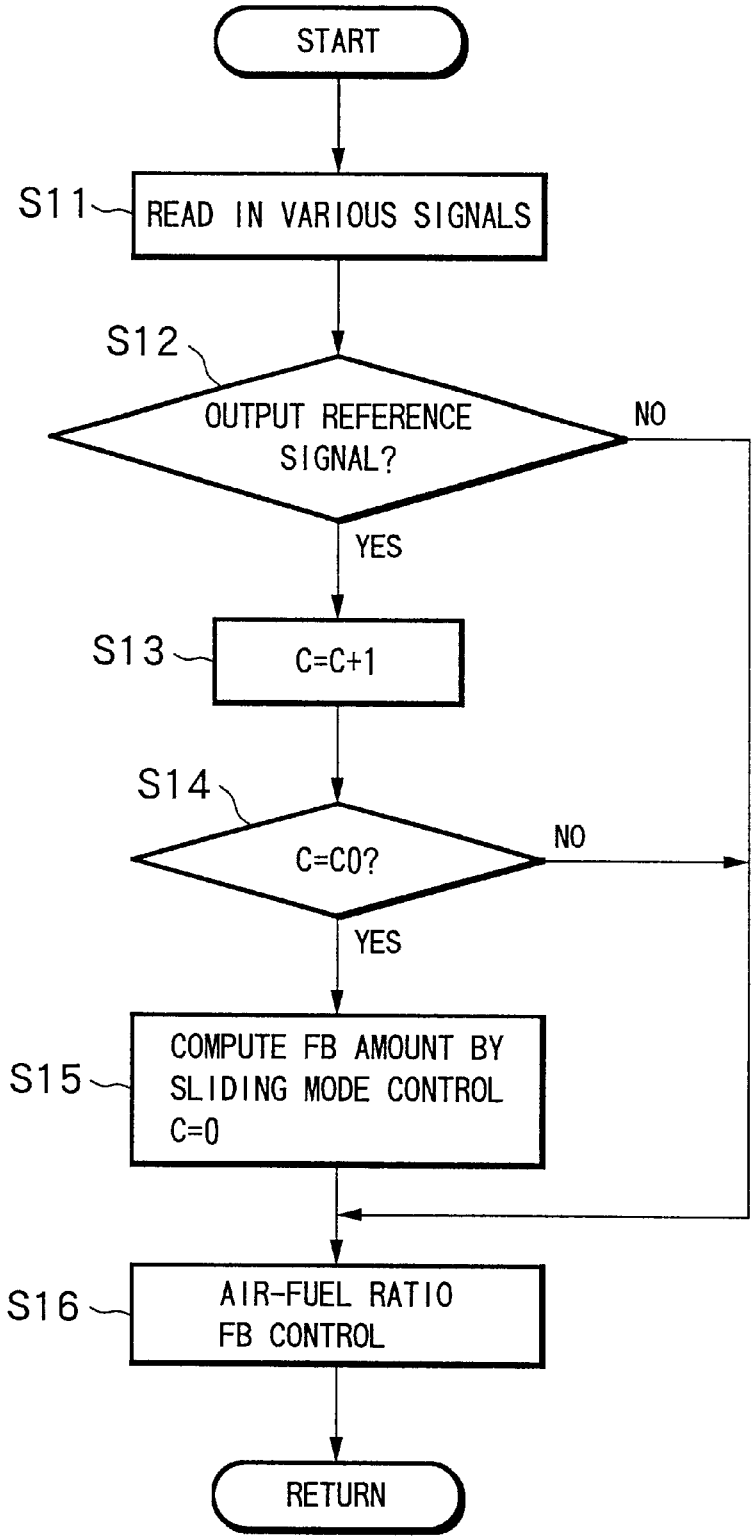
FIG. 10 is a flowchart showing the air-fuel ratio feedback control routine of a sixth embodiment.

Next, the sixth embodiment is explained according to the flowchart of FIG. 10.

Steps 11 and 12 are similar to steps 1 and 2. When a reference signal is output, the procedure is advanced to step 13, where a counter is counted up. In step 14, determination is made on whether or not the counted value C has reached a predetermined number C0. Here, the predetermined number C0 is set to a value obtained by converting the dead time to the number of discharge stroke cycles (in the example mentioned above, 3).

When it is determined to have reached the predetermined number, the procedure is advanced to step 15, where according to the sliding mode control, the feedback control amount is computed. After resetting the counter value C0 to 0, the air-fuel ratio control is executed using the feedback control amount in step 16.

Accordingly, a new feedback control amount is computed based on the detected result of air-fuel ratio controlled by the feedback control amount computed at the previous time, and therefore, the excessive correction amount is reduced as much as possible. Therefore, the sliding mode control with minimum deviation from the target air-fuel ratio can be performed. As a result, the feedback gain can be sufficiently increased, and the response characteristic can be sufficiently improved.

Figure 11:
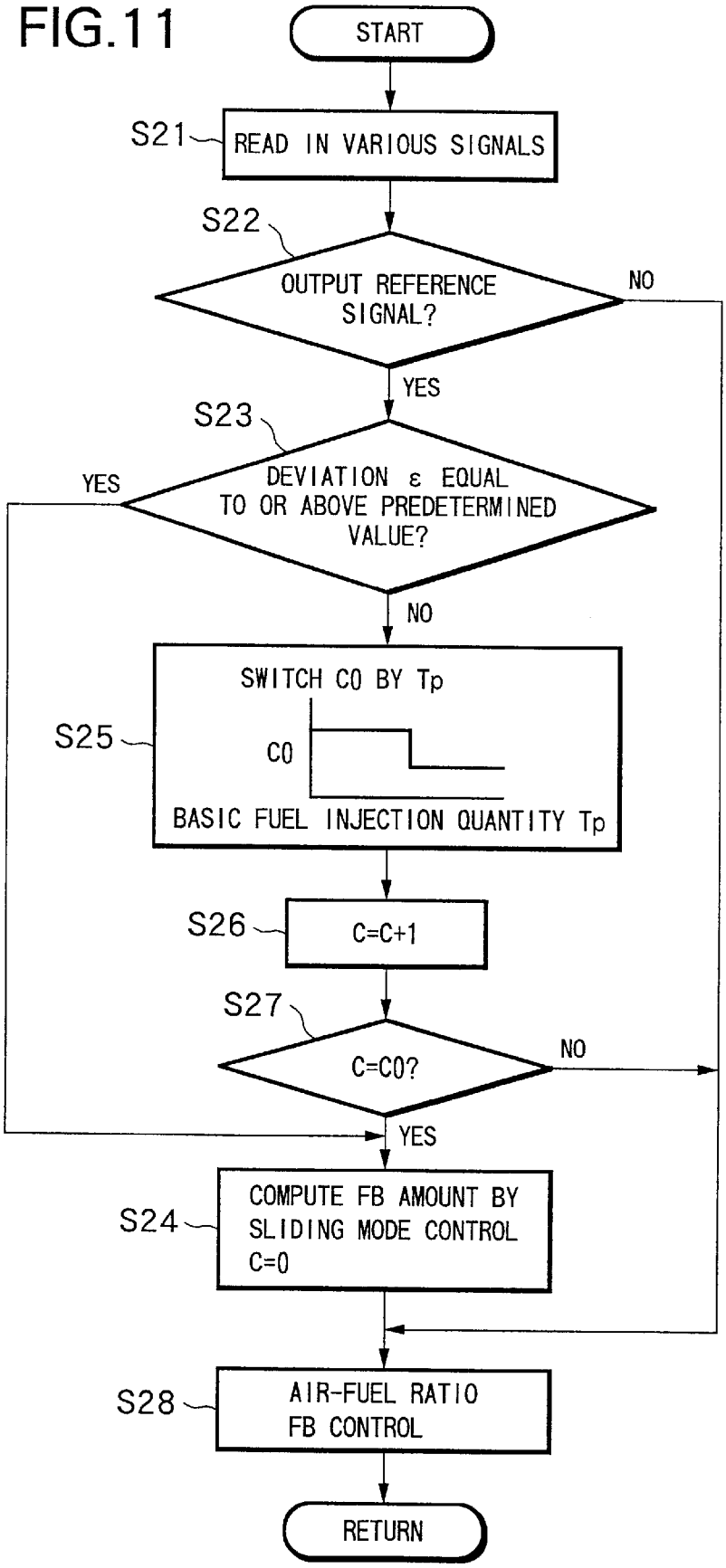
FIG. 11 is a flowchart showing the air-fuel ratio feedback control routine of a seventh embodiment.

Next, the seventh embodiment is explained according to the flowchart of FIG. 11.

Steps 21 and 22 are similar to steps 1 and 2 mentioned above. When a reference signal is output, the procedure is advanced to step 23, where determination is made on whether or not the deviation between the target air-fuel ratio and the detected actual air-fuel ratio is equal to or above a predetermined value.

When it is determined that the deviation is equal to or above the predetermined value, the procedure is advanced to step 24, where the feedback control amount is computed based on the sliding mode control.

When the deviation is determined to be below the predetermined value, the procedure is advanced to step 25, where based on the basic fuel injection quantity Tp, the predetermined number C0 is set. Here, the predetermined number C0 is set to a value obtained by converting the dead time to the number of discharge stroke cycles, but when the amount of exhaust per one cylinder represented by the basic fuel injection quantity Tp is large, it is considered that the number of discharge stroke cycles needed for the exhaust to reach the air-fuel ratio sensor from the combustion chamber is reduced compared to when the exhaust amount is small. Therefore, corresponding to this tendency, the predetermined number C0 is switchingly set.

In step 26, the counter is counted up. When it is determined in step 27 that the counter value C has reached the predetermined number C0, the procedure is advanced to step 24, where according to the sliding mode control, the feedback control amount is computed.

In step 28, the air-fuel ratio control is executed utilizing the feedback control amount computed as above.

Thereby, when the deviation is large, the feedback control amount is computed and updated for every stroke cycle, and a higher response characteristic can be realized. When the deviation is small, the computing cycle is increased to a cycle corresponding to the dead time (multiple of the stroke cycle), and at the same time, the cycle is switched based on the basic fuel injection quantity Tp. Thereby, excessive correction during dead time is restrained more accurately, and the control can be executed with deviation from the target air-fuel ratio reduced as much as possible.

Moreover, compared to the complicated control according to the conventional sliding mode control, according to the present embodiment, the excessive correction can be restrained by a simple control of synchronizing basically the computing cycle to the stroke cycle. Therefore, there is no influence by a change in the system with time lapse, and the consumption capacity of the ROM and RAM are reduced.

Moreover, an inner-cylinder pressure detecting signal from an inner-cylinder pressure sensor utilized for detecting knocking and the like can be used instead of the reference signal from the crank angle sensor. In such a case, the signal increased at the top dead center of compression can be utilized as a signal detecting the predetermined stroke timing of each cylinder.

Next, another embodiment (eighth embodiment) of the present invention is explained, in which the stability and the response characteristic of the control system are simultaneously ensured by eliminating the influence from the dead time element existing in the control object, without depending on the later correction of the feedback control amount.

In order to clarify the feature of the present invention, detailed description is provided on the phase delay caused by the dead time element such as the transfer delay of the exhaust and the like.

The phase delay of the detected air-fuel ratio caused by the transfer delay of the exhaust generally has a nature of changing in correlation with the intake air quantity. Actually, when the intake air quantity is large, the flow speed of the exhaust is increased and transfer delay is reduced, and therefore the phase delay of the detected air-fuel ratio is also reduced. However, when the intake air quantity is small, as is the case during idle state, the flow speed of the exhaust is reduced and the transfer delay is increased, resulting in greater phase delay of the detected air-fuel ratio.

Figure 19A:
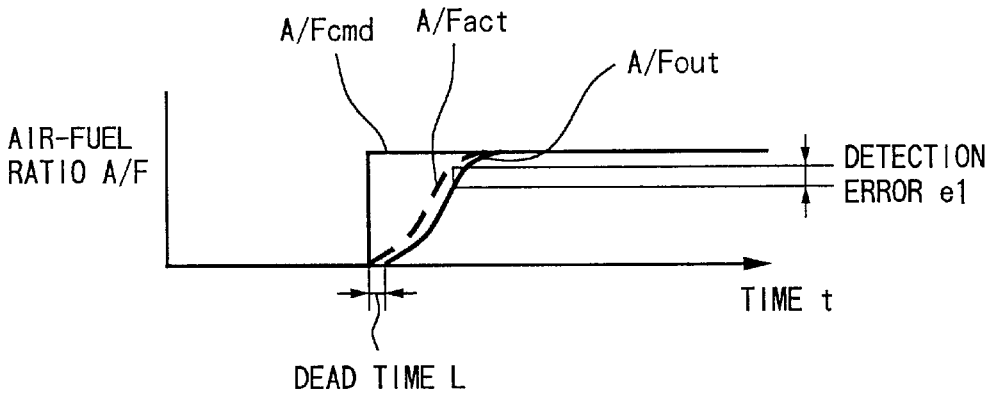
FIG. 19 is a time chart showing the influence provided by a dead time element.
Figure 19B:
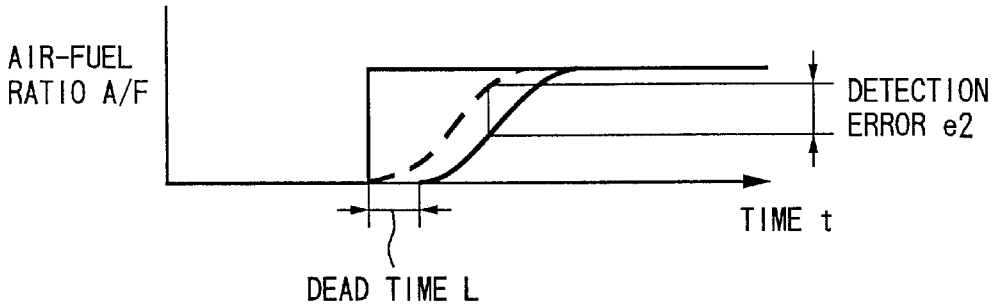

This is explained with reference to FIG. 19. FIG. 19(*a*) shows the state where phase delay is small, and FIG. 19(*b*) shows the state where phase delay is large. Moreover, A/Fcmd shows the target air-fuel ratio, A/Fout shows the detected air-fuel ratio, and A/Fact shows the actual air-fuel ratio within the combustion chamber. When a large phase delay is included in the detected air-fuel ratio A/Fout, the error e2 between the actual air-fuel ratio A/Fact and the detected air-fuel ratio A/Fout (that is, the air-fuel ratio input to the electronic control unit) is increased. In such a case, the air-fuel ratio is feedback-controlled based on an information far different from the actual state of the combustion chamber, which leads to deterioration of the control system stability, and causes divergence.

Therefore, according to the second embodiment, the feedback control amount computed based on the detected air-fuel ratio is corrected using the gain correction value set based on the intake air quantity, in order to correct lately the influence of the dead time element existing in the control object. Moreover, in order to set the feedback control amount without receiving influence from such dead time element, the control amount can be set directly based on a plural parameters such as intake air quantity, the water temperature and the intake pressure.

However, as mentioned above, when correcting the post-computed feedback control amount based on the intake air quantity, dispersion can be restrained leading to an effect in stabling the control system. However, since the information itself (that is, the detected air-fuel ratio) used to compute the feedback correction amount still includes phase delay, the influence provided by the dead time element can not be eliminated completely. Especially, when the feedback control amount is computed based on the sliding mode control, the influence is even more important compared to the other feedback control figures.

In other words, the direction of increase or decrease of the nonlinear component generating the sliding mode of state quantity is switched by the sign of deviation between the detected air-fuel ratio and the target air-fuel ratio (error quantity). Therefore, in case the detected air-fuel ratio is detected as a value greatly deviated from the actual air-fuel ratio, the nonlinear component may be increased or decreased in the wrong direction (in the opposite direction to that to be changed). As for another problem, since the air-fuel ratio is controlled using a feedback control amount that is reduced rather compulsively, the response characteristic of the control system can not be ensured.

On the other hand, when setting the feedback control amount based on a plural number of parameters, the number of steps for setting the feedback control amount or the memory capacity of the electronic control unit is increased, causing problems.

Figure 12:
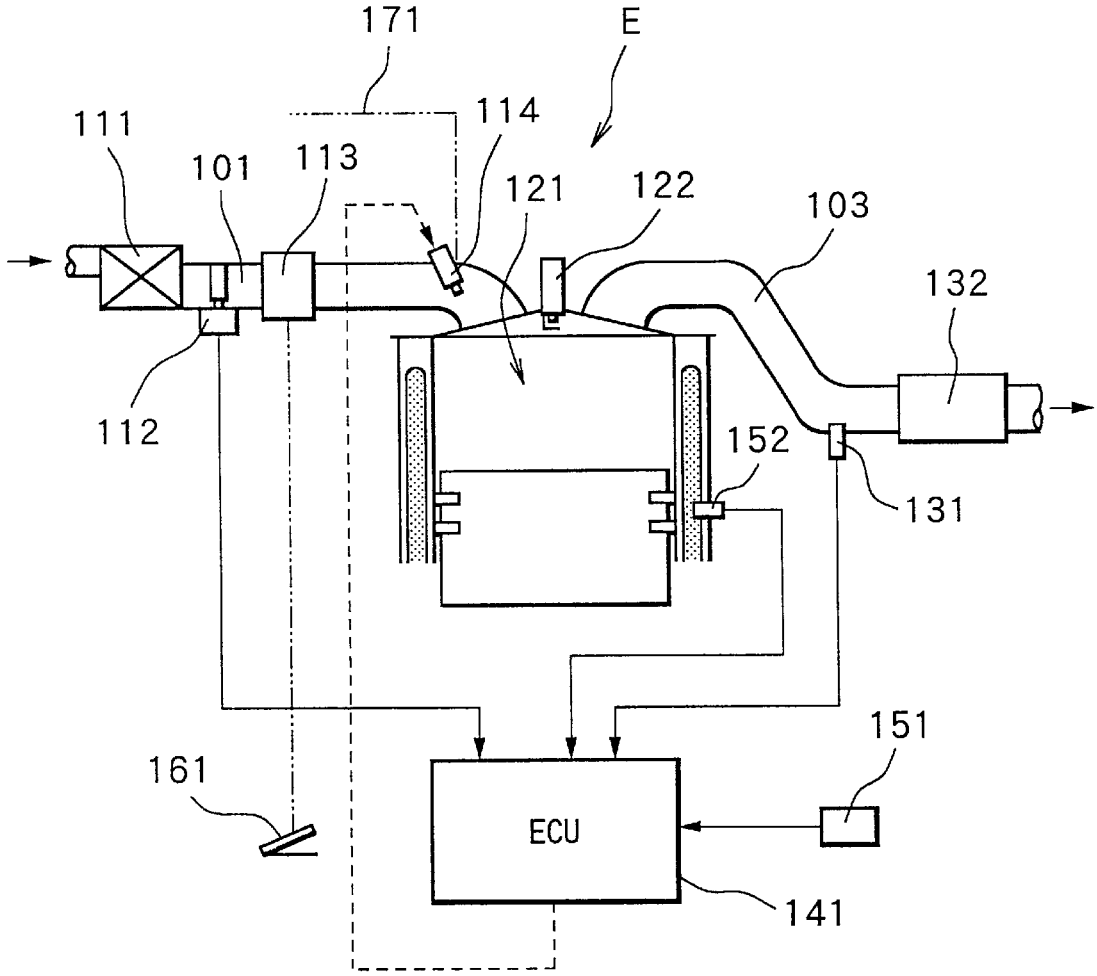
FIG. 12 is a drawing showing the system structure of an eighth embodiment.

The embodiment of the present invention solving the above problem is now explained with reference to the drawings. FIG. 12 is a diagram of the simplified system structure of the present embodiment.

An airflow meter 112 for detecting the airflow (intake airflow quantity Qa) that traveled through an air cleaner 111 for removing dust existing in the air, and a throttle valve 113 for controlling the intake airflow quantity Qa by interlocking with an accelerator pedal 161, are provided in an intake passage 101 of an engine E. An electromagnetic fuel injection valve 114 is mounted to the manifold portion placed on the downstream side of the passage for each cylinder, serving as a fuel supply device. The fuel injection valve 114 is driven to open by an electric signal provided from an electronic control unit 141, to injectingly supply fuel which has been sent under pressure through a fuel pipe 171 from a fuel pump (not shown). Moreover, a manifold portion of the intake passage 101 is communicated to a combustion chamber 121 at one side of each cylinder, and at the substantial center of each combustion chamber 121 is provided a spark plug 122 for igniting the mixture introduced from the intake passage 101.

On the other hand, a wide-range air-fuel ratio sensor 131 is equipped to an exhaust passage 103 for detecting an air-fuel ratio (detected air-fuel ratio A/Fout) linearly according to the oxygen concentration in the exhaust. Moreover, a catalytic converter 132 including a ternary catalyst is equipped to the exhaust passage 103 for oxidizing the C0 and HC and reducing the NOx in the exhaust.

The electronic control unit 141 receives, other than the intake air quantity Qa and the detected air-fuel ratio A/Fout, signals from a crank angle sensor 151 (based on which the engine rotation speed Ne is computed), and the cooling water temperature Tw detected by the temperature sensor 152, in order to carry out the air-fuel ratio control explained below.

Figure 13:
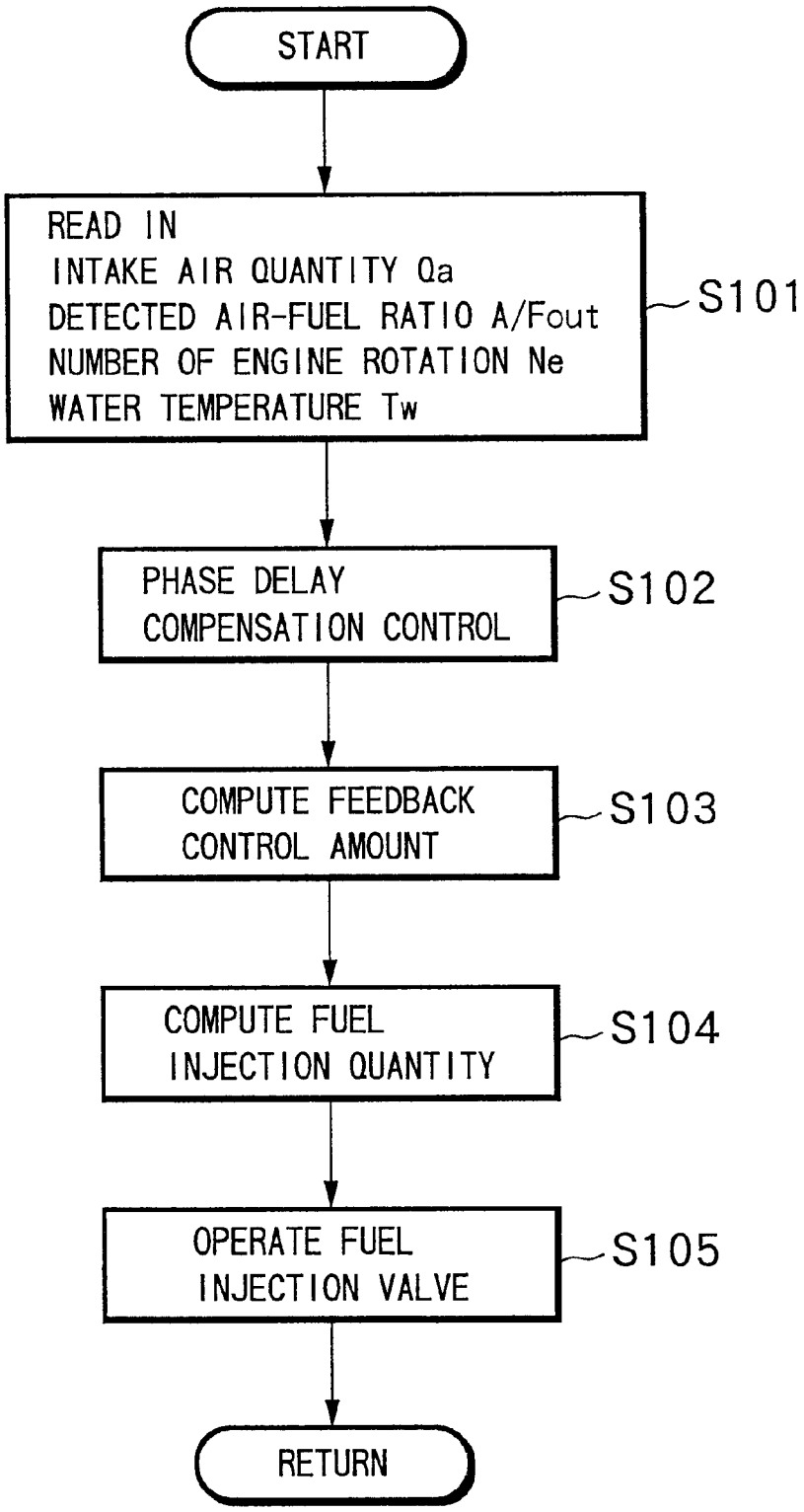
FIG. 13 is a flowchart showing the air-fuel ratio feedback control routine of the above embodiment of FIG. 12.
Figure 14:
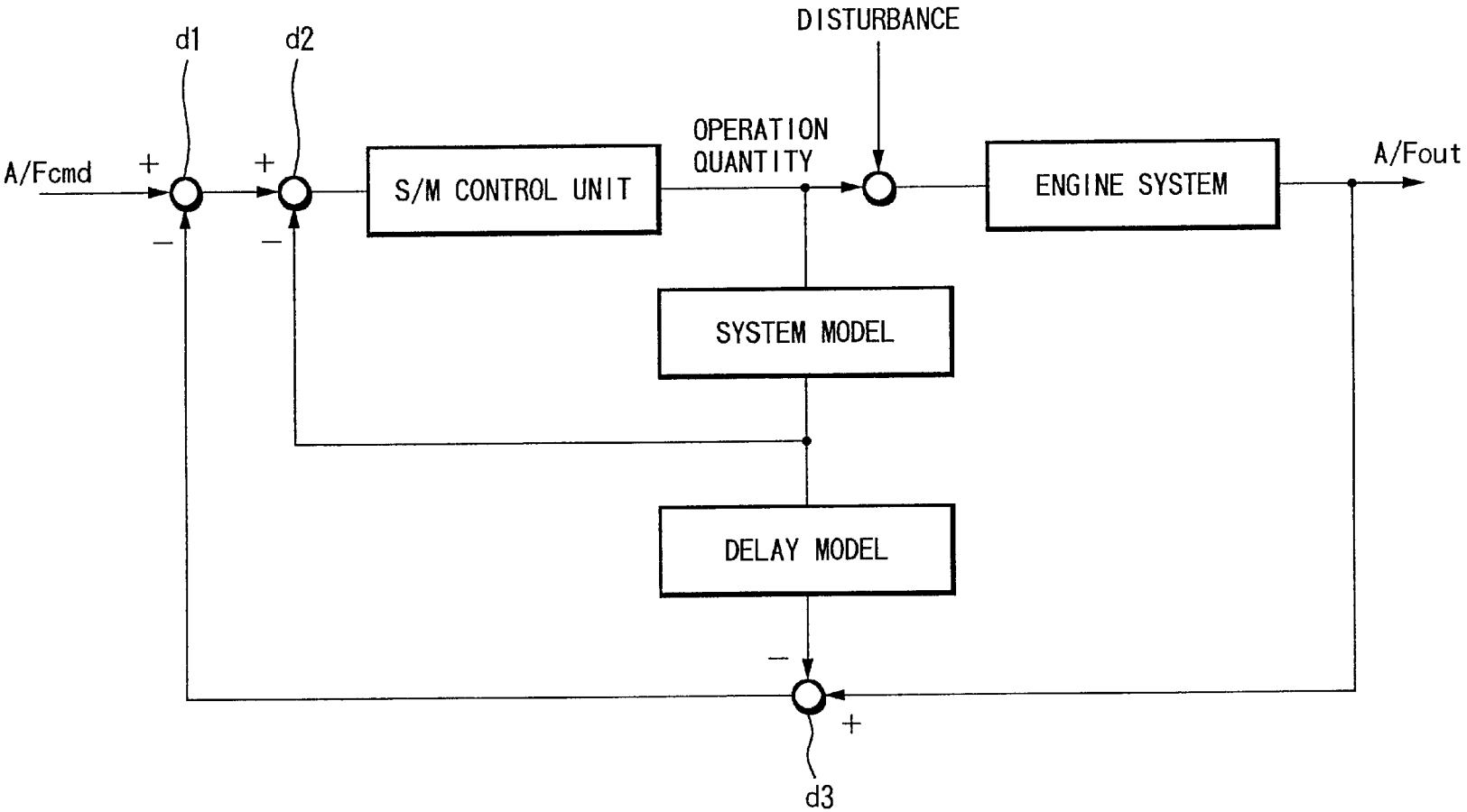
FIG. 14 is a drawing showing the phase delay compensation control of the detected air-fuel ratio in the air-fuel ratio control of FIG. 13.

FIG. 13 shows the outline of the flow of air-fuel ratio control. The electronic control unit 141 reads in various signals such as the intake airflow quantity Qa in step 101. Then, in step 102, the phase delay compensation control according to the present embodiment is performed. The phase delay compensation control will now be explained with reference to the function block diagram shown in FIG. 14.

The phase delay compensation control according to the present embodiment is constituted based on the compensation control method proposed by Otto Smith. The feedback control system computes the deviation between the target air-fuel ratio A/Fcmd and the detected air-fuel ratio A/Fout in a first subtraction unit d1, then performs the sliding mode control in the sliding mode control unit (S/M control unit) based on the computed deviation to compute the operation quantity, and applies the operation quantity to the engine system, which is the object of control (plant). A compensating operation is added to the feedback control system, so that the feedback control can be performed by excluding the dead time element existing in the engine system under a certain condition to the exterior of the feedback loop.

That is, the operation quantity from the S/M control unit is introduced to a second subtraction unit d2 provided on the input side of the S/M control unit on the output side of the first subtraction unit d1 via a transfer function Gm representing a model (system model) that does not include the dead time element of the engine system. At the same time, the operation quantity from the S/M control unit is introduced to a third subtraction unit d3 via a transfer function (the product of transfer function Gm and a transfer function representing the model showing the dead time element (delay model)) representing a model including the dead time element of the engine system. Then, the deviation between the detected air-fuel ratio A/Fout and the output from the delay model is introduced to the first subtraction unit d1.

The engine system model mentioned here is either obtained by theoretically modeling the actual system, or obtained through identification based on the response data of the actual system. Then, the transfer function Gm representing the system model could be represented as Gm=(as+b)/(cs2+ds+e), where constant c and constant d are set as time constant (for example, a=−20.2, b=−2113.1, c=1, d=134.6737, e=190.2974). Further, the transfer function representing the delay model is shown as $e^{-gs}$ (where g is delay time, for example, g=50). Accordingly, the transfer function representing the model including the dead time element of the engine system is represented as $Gm \times e^{gs} = (as+b)/(cs2+ds+e) \times e^{-gs}$.

Figure 15:
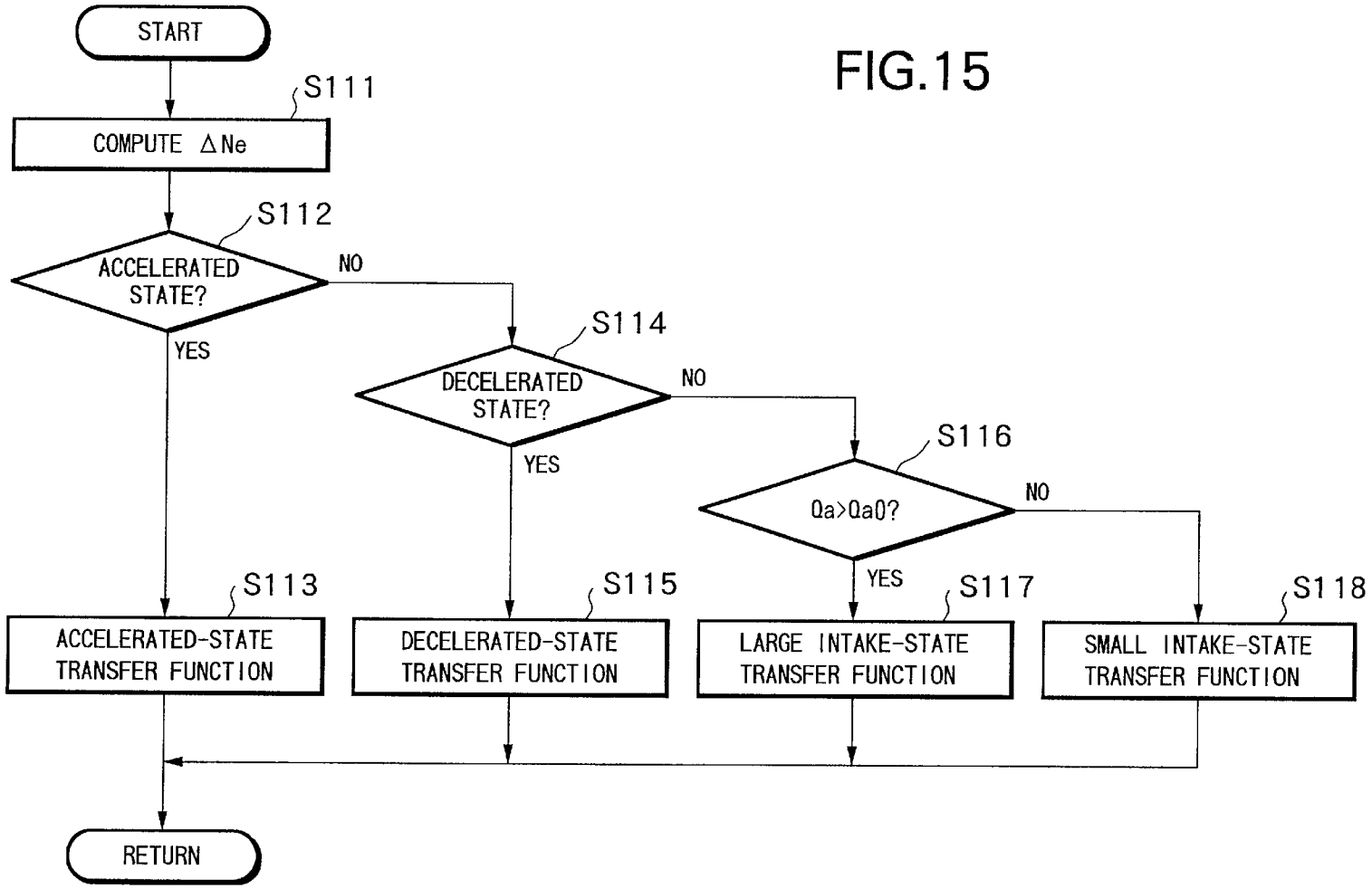
FIG. 15 is a flowchart showing one example of the switching control of a transfer function.

These transfer functions Gm and $e^{gs}$ are switched according to the operating conditions of the engine. The switching is carried out as shown in FIG. 15, corresponding to the acceleration or deceleration of the engine.

After computing the rate of change (in other words, acceleration) ΔNe of the engine rotation speed Ne in step 111, determination is made in step 112 on whether or not the engine is in an accelerated state based on ΔNe. When the engine is in an accelerated state, the procedure is advanced to step 113, where an accelerated-state transfer function representing the model of the engine system during accelerated state is set. According to the accelerated-state transfer function, either the order of the transfer function Gm representing the system model is set to a low value (for example, Gm=(b')/(d's+e')), or the time constant c and d and the dead time g are set to a small value.

On the other hand, when the engine is not in an accelerated state, the procedure is advanced to step 114, where determination is made on whether the engine is in a decelerated state or not. When the engine is in a decelerated state, the procedure is advanced to step 115, where a decelerated-state transfer function representing the model of the engine system during deceleration state is set. According to the decelerated-state transfer function, either the order of the transfer function Gm representing the system model is set to a high value (for example, Gm=(a's+b')/(f's3+c's2+d's+e'), or the time constant c and d and the dead time g are set to a large value. When the engine is neither accelerated or decelerated, and is in a steady state, the steady-state transfer function representing the engine system model during the steady state is set in step 116 and the subsequent steps.

The steady-state transfer function is switched according to the intake air quantity Qa (or a corresponding value set depending on the intake air quantity Qa). When the intake air quantity Qa is judged to be greater than a predetermined quantity Qa0 in step 116, the procedure is advanced to step 117, where a large intake-state transfer function is set. On the other hand, when the intake air quantity Qa is judged to be equal to or smaller than the predetermined quantity Qa0 in step 116, the procedure is advanced to step 118, where a small intake-state transfer function is set. According to the large intake-state transfer function, the dead time g is set small, and in the small intake-state transfer function, the dead time g is set large.

By switching the transfer function based on the operating condition of the engine, even in a case that the operating condition of the engine is changed for example by the decrease in intake air quantity Qa that leads to change in the properties of the response delay elements of the system including the filling of the gas in the cylinder and the adhesion of fuel to the surface of the intake pipe, the change in the variety and number of response delay elements that leads to the change in the engine system characteristics, or the change (increase in dead time) in the transfer characteristics of the exhaust accompanied by the decrease in intake air quantity Qa, the engine system will correspond to the change in the operating conditions of the engine, and will utilize the most preferable model based on the change.

As a result that the best model is utilized as mentioned above, when the influence from disturbance is small, the operation by the third subtraction unit d3, $Gp\times e^{-Ls}-Gm\times e^{-gs}$ (transfer function $Gp\times e^{-Ls}$ represents the actual engine system, in which Gp represents the actual engine system excluding the dead time element, $e^{-Ls}$ represents the dead time element existing in the engine system, and L represents dead time) is Gp=Gm and L=g. Thereby, the phase delay included in the detected air-fuel ratio A/Fout can be compensated accurately. According to such case, the equivalent transformation of the function block diagram of FIG. 14 could be shown as FIG. 16.

Figure 16:
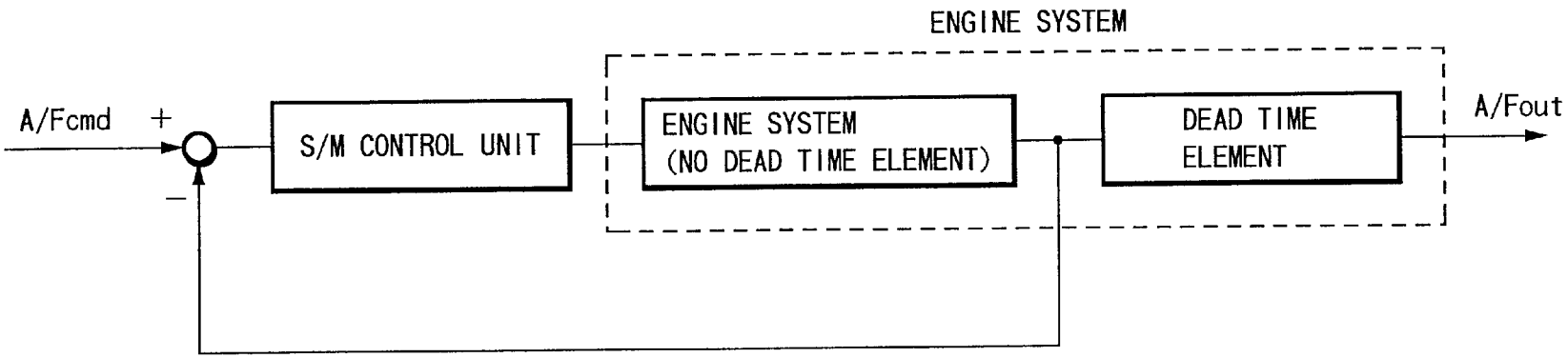
FIG. 16 shows the influence of a phase delay compensation control of the detected air-fuel ratio in the air-fuel ratio control of FIG. 13.

According to FIG. 16, the dead time element existing in the engine system is taken out of the feedback loop, and the S/M control unit computes the feedback control amount using the engine system excluded of the dead time element, or an output (A/Fact') that passed through only the transfer function Gm representing the system model excluding the dead time element, thereby computing the feedback control amount excluding the influence from dead time elements.

Figure 17:
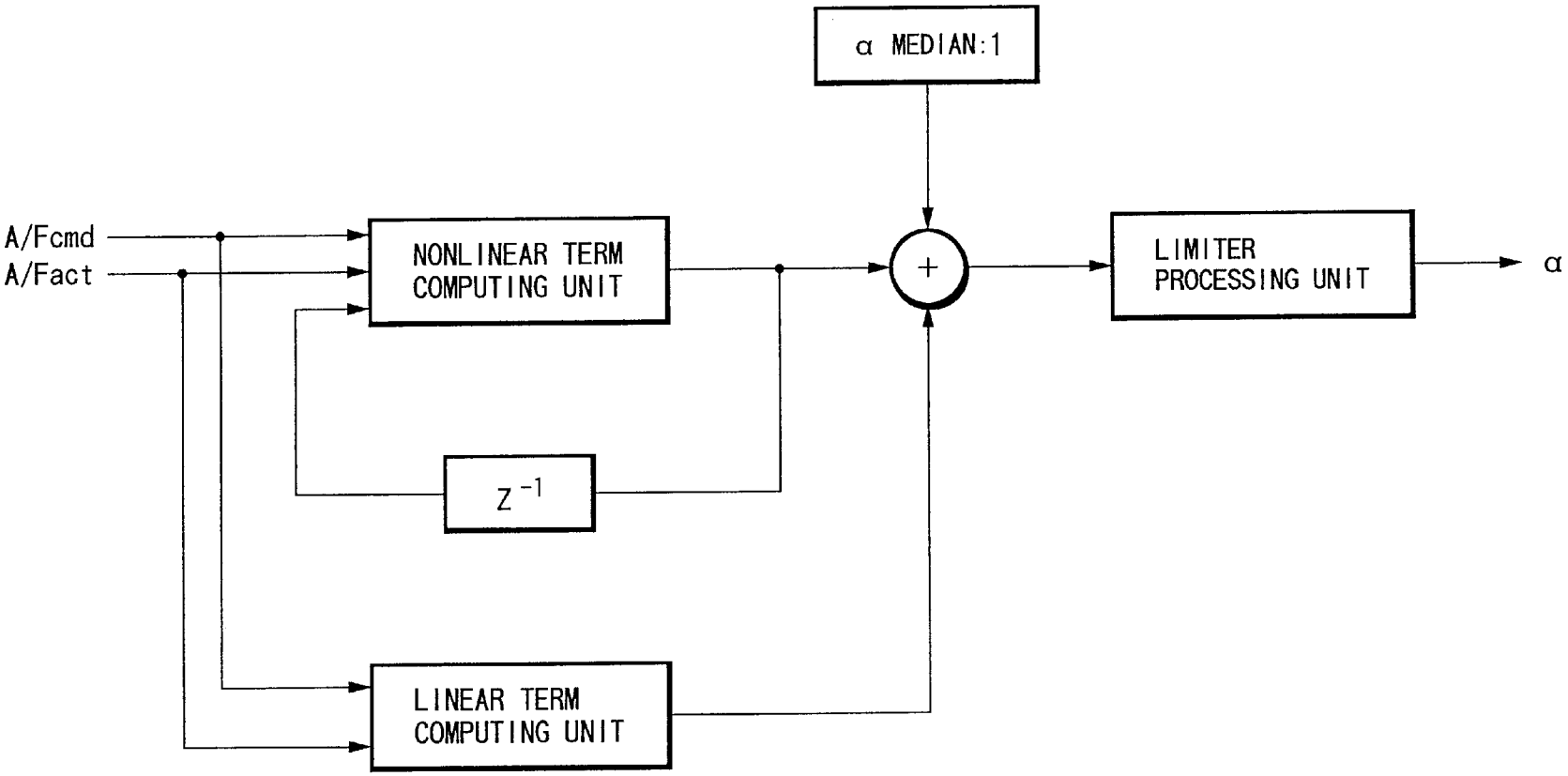
FIG. 17 is a block diagram showing the calculating steps of a feedback control amount in the air-fuel ratio control of FIG. 13.

The computing of the feedback control amount by the S/M control unit (FIG. 13, step 103) is carried out as shown in FIG. 17. The feedback control amount consists of a nonlinear component UnL and a linear component UL, wherein the switching function S is set by the direct switching function method according to the sliding mode control as S=A/Fact'−A/Fcmd. The nonlinear component UnL is computed according to formula (1) by the nonlinear term computing unit, and the linear component UL is computed according to formula (2) by the linear term computing unit.

$$UnL=G1\times(A/Fact'-A/Fcmd)/|A/Fact'-A/Fcmd|+UnLold \quad (1)$$

Where UnLold is the previous value of the feedback gain according to the nonlinear component.

$$UL=G2\times(A/Fact'-A/Fcmd)/(A/Fact') \quad (2)$$

According to the above formula, the switching function S is set as S=A/Fact"A/Fcmd, so that the switching plane S=0 becomes the desired state of A/Fact'=A/Fcmd. Every time the switching plane is crossed, the direction of increase or decrease (positive or negative) of the feedback gain according to the nonlinear component UnL is switched. The nonlinear component UnL is computed as a value obtained by integrating the feedback gain that switches the direction of increase or decrease on the switching plane.

The linear component UL is set to adjust the speed for converging the state quantity to the switching plane when the target air-fuel ratio A/Fcmd is switched greatly. The linear component UL is set to a greater value when the deviation (A/Fact'−A/Fcmd) is greater, so that the state quantity is converged promptly to the switching plane, and is reduced to a smaller value as the quantity approaches the switching plane, thereby preventing overshoot.

Utilizing the computed feedback control amount, the feedback correction coefficient α to be used for calculating the fuel injection quantity is computed. Here, the linear component UL from the linear term computing unit is added to the nonlinear component UnL from the nonlinear term computing unit, and further, the median of the feedback correction coefficient α (value corresponding to no feedback=1) is added. After limiter process is carried out at the limiter processing unit so that the obtained value is both equal to or above the lower limit and equal to or below the upper limit, the feedback correction coefficient α is output.

Next, the fuel injection quantity (fuel injection pulse width) Ti is computed using the output feedback correction coefficient α (FIG. 13, step 104), and a drive signal (pulse signal) is output to the fuel injection valve 114 so as to inject the corresponding amount of fuel (FIG. 13, step 105), and the air-fuel ratio of the mixture is controlled to the target value. Here, the computing of the fuel injection quantity Ti may be similar to that of the conventional air-fuel ratio control. For example, the basic fuel injection quantity, computed based on the intake air quantity Qa and the engine rotation speed Ne, is corrected using various correction coefficients based on the cooling water temperature Tw and the like. The thus obtained value is multiplied by the feedback correction coefficient α, and to that value is added the battery voltage correction value.

According to the above explanation, the transfer function representing the engine system model is switched according to the accelerated state or the decelerated state of the engine. However, such switching can be carried out according to the temperature of the intake pipe walls instead of the acceleration and deceleration of the engine. For this purpose, the cooling water temperature Tw is detected to estimate the intake pipe wall temperature, and the model is switched by comparing the temperature Tw with the reference temperature Tw0.

Figure 18:
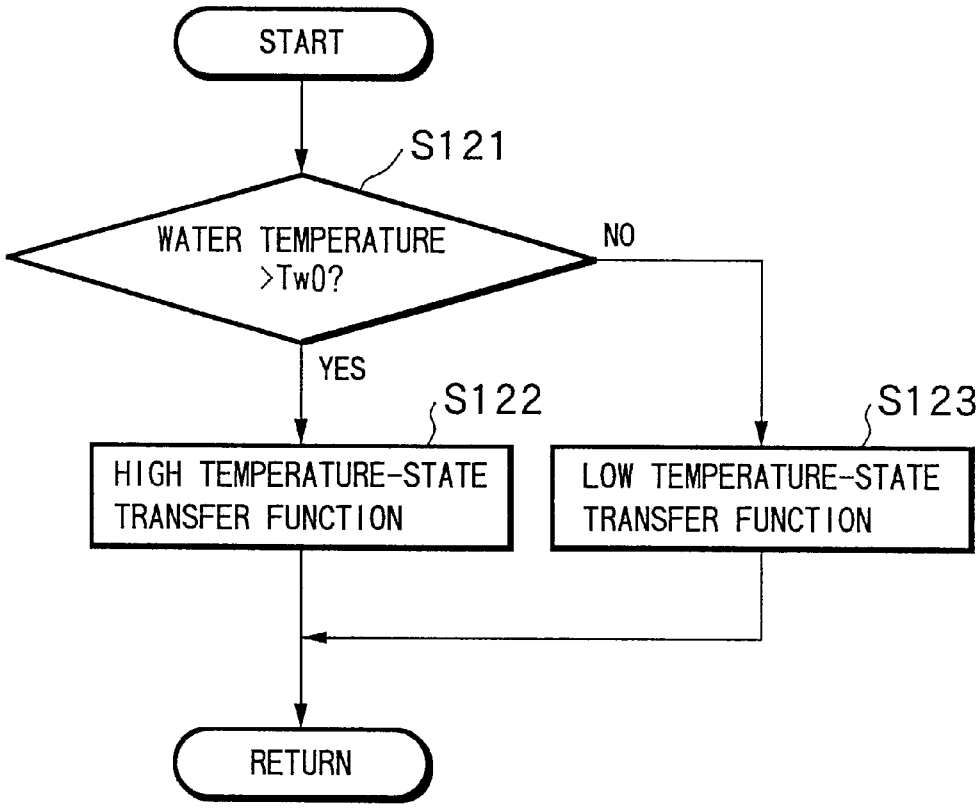
FIG. 18 is a flowchart showing another example of the switching control of a transfer function.

In other words, as disclosed in step 121 of FIG. 18, determination is made on whether the cooling water temperature Tw is higher than the reference temperature Tw0 or not. When it is higher, the procedure is advanced to step 122, where high temperature-state transfer function representing the engine system model during high temperature-state is set. According to the high temperature-state transfer function, the time constant c and d and the dead time g are set small. On the other hand, when the cooling water temperature Tw is equal to or below the reference temperature Tw0, the procedure is advanced to step 123, where low temperature-state transfer function representing the engine system model during low temperature-state is set. According to the low temperature-state transfer function, the time constant c and d and the delay time g are set high.

The intake pipe wall temperature can be estimated by estimating not only the cooling water temperature Tw but also the lubricating oil temperature or the intake air temperature, and by comparing the detected temperatures with the respective reference temperatures. Moreover, the switching of the engine system model is not limited to such a single constant, but a more precise switching can be carried out using tables and maps.

As explained above, by switching the engine system model based on the intake pipe wall temperature (estimated value), the model can be switched corresponding to the change in system characteristics especially caused by the change in vaporization property of the fuel adhered to the intake pipe wall surface, to compensate for the phase delay included in the detected air-fuel ratio A/Fout.

The present embodiments utilizes a Smith method to compensate for the phase delay, by subtracting the output that passed through a model ($Gm \times e^{-gs}$) from the output that passed through the actual engine system ($Gp \times e^{-Ls}$), in other words, by computing $Gp \times e^{-Ls} - Gm \times e^{-gs}$. However, the phase delay may also be compensated according to a Bertley method and the like, by providing a dividing unit that divides the output that passed through the actual engine system by the output that passed through the model, in other words, by computing $(Gp \times e^{-Ls})/(Gm \times e^{-gs})$, instead of the third subtraction unit d3.

As explained above, according to the present invention, the feedback control amount can be computed while eliminating the influence from the dead time element existing in the engine system. This not only leads to maintaining the stability of the control system, but also enables to output a large feedback control amount throughout the whole region of the operating condition of the engine, thereby ensuring the response characteristic of the control system.

The entire contents of Japanese Patent Applications No. 11-296907 filed on Oct. 19, 1999, No. 11-296908 filed on Oct. 19, 1999 and No. 11-354262 filed on Dec. 14, 1999 are incorporated herein by reference.

We claim:

1. An air-fuel ratio control device of an internal combustion engine, in which an air-fuel ratio is feedback controlled so as to approximate a target air-fuel ratio set depending on engine operating conditions, said air-fuel ratio control device comprising:

an air-fuel ratio detecting means for detecting the air-fuel ratio linearly;

a feedback control amount computing means for computing a feedback control amount based on a sliding mode control in which a deviation between said target air-fuel ratio and said detected air-fuel ratio detected by said air-fuel ratio detecting means is set as a switching function; and an air-fuel ratio feedback control means for carrying out a feedback control using said feedback control amount, so as to approximate said detected air-fuel ratio to said target air-fuel ratio.

2. The air-fuel ratio control device of an internal combustion engine according to claim 1, wherein said feedback control amount computing means computes a feedback control amount including a linear term computed as a value proportional to a ratio of the deviation between said target air-fuel ratio and said detected air-fuel ratio to said detected air-fuel ratio, and a non-linear term computed by integrating a feedback gain, the positive or negative of which is switched according to whether said switching function is positive or negative.

3. The air-fuel ratio control device of an internal combustion engine according to claim 1, wherein said feedback control amount computing means computes a feedback control amount including a linear term computed as a value proportional to a ratio of the deviation between said target air-fuel ratio and said detected air-fuel ratio to said detected air-fuel ratio, and a non-linear term computed by integrating a feedback gain, the positive or negative of which is switched according to whether said switching function is positive or negative, and the absolute value of which is set to a greater value as an intake air quantity increases.

4. The air-fuel ratio control device of an internal combustion engine according to claim 1, wherein said feedback control amount computing means computes a feedback control amount including a linear term computed as a value proportional to a ratio of the deviation between said target air-fuel ratio and said detected air-fuel ratio to said detected air-fuel ratio, and a non-linear term computed by integrating a feedback gain, the positive or negative of which is switched according to whether said switching function is positive or negative, and the absolute value of which is set to a greater value as the engine rotation speed increases.

5. The air-fuel ratio control device of an internal combustion engine according to claim 1, further comprising a computing cycle control means for controlling the computing cycle so that said feedback control amount computing means computes said feedback control amount in synchronism with the stroke cycle of said engine.

6. The air-fuel ratio control device of an internal combustion engine according to claim 1, further comprising a computing cycle control means for controlling the computing cycle so that said feedback control amount computing means computes said feedback control amount in a cycle variably set according to the operating conditions of said engine.

7. The air-fuel ratio control device of an internal combustion engine according to claim 1, further comprising a computing cycle control means for controlling the computing cycle so that said feedback control amount computing means computes said feedback control amount according to a cycle variably set according to the deviation between said target air-fuel ratio and the actual air-fuel ratio detected by said air-fuel ratio detecting means.

8. The air-fuel ratio control device of an internal combustion engine according to claim 1, further comprising a computing cycle control means for controlling the computing cycle so that said feedback control amount computing means computes said feedback control amount in synchronism with a signal detecting a predetermined stroke timing of each cylinder.

9. An air-fuel ratio control device of an internal combustion engine, in which an air-fuel ratio is feedback controlled so as to approximate a target air-fuel ratio set depending on engine operating conditions, said air-fuel ratio control device comprising:

an air-fuel ratio detecting means for detecting the air-fuel ratio linearly;

a phase delay compensating means for compensating for a phase delay caused by a dead time element of a control object included in the detected air-fuel ratio detected by said air-fuel ratio detecting means, using a model of said control object represented by a transfer function that is switched according to the operating conditions of said engine; and a feedback control amount computing means for computing a feedback control amount using the detected air-fuel ratio whose phase delay is compensated for by said phase delay compensating means, based on a sliding mode control in which a deviation between said target air-fuel ratio and the actual air-fuel ratio detected by said air-fuel ratio detecting means is set as the switching function.

10. The air-fuel ratio control device of an internal combustion engine according to claim 9, wherein said phase delay compensating means compensates for, through Smith dead-time compensation control, the phase delay caused by the dead time element of the control object.

11. A method for controlling an air-fuel ratio of an internal combustion engine, wherein an air-fuel ratio is feedback controlled so as to approximate a target air-fuel ratio set depending on engine operating conditions, said method comprising the steps of:

detecting the air-fuel ratio linearly;

computing a feedback control amount based on a sliding mode control in which a deviation between said target air-fuel ratio and said detected air-fuel ratio is set as a switching function; and carrying out the feedback control using said computed feedback control amount, so as to approximate said detected air-fuel ratio to said target air-fuel ratio.

12. The method for controlling an air-fuel ratio of an internal combustion engine according to claim 11, wherein said feedback control amount includes a linear term and a nonlinear term.

13. The method for controlling an air-fuel ratio of an internal combustion engine according to claim 12, wherein said linear term is computed as a value proportional to a ratio of the deviation between said target air-fuel ratio and said detected air-fuel ratio to said detected air-fuel ratio.

14. The method for controlling an air-fuel ratio of an internal combustion engine according to claim 12, wherein said nonlinear term is computed by integrating a feedback gain, the positive or negative of which is switched according to whether the switching function is positive or negative.

15. The method for controlling an air-fuel ratio of an internal combustion engine according to claim 14, wherein the absolute value of said feedback gain is set to vary according to the operating conditions of said engine.

16. The method for controlling an air-fuel ratio of an internal combustion engine according to claim 15, wherein the absolute value of said feedback gain is set to a greater value as the intake air quantity increases.

17. The method for controlling an air-fuel ratio of an internal combustion engine according to claim 15, wherein the absolute value of said feedback gain is set to a greater value as the engine rotation speed increases.

18. The method for controlling an air-fuel ratio of an internal combustion engine according to claim 11, wherein said air-fuel ratio is detected by a wide-range air-fuel ratio sensor that detects the air-fuel ratio linearly based on a specific component in the exhaust.

19. The method for controlling an air-fuel ratio of an internal combustion engine according to claim 11, wherein said air-fuel ratio is detected by a narrow-range air-fuel ratio sensor that detects the rich or lean of the air-fuel ratio in an on/off manner based on a specific component in the exhaust, and the value detected by said narrow-range air-fuel ratio sensor is linearized to be used to compute the feedback control amount.

20. A method for controlling an air-fuel ratio of an internal combustion engine, wherein an air-fuel ratio is feedback controlled so as to approximate a target air-fuel ratio set depending on engine operating conditions, said method comprising the steps of:

detecting the air-fuel ratio linearly;

controlling the computing cycle so that a feedback control amount for said feedback control is computed in synchronism with the stroke cycle of said engine;

computing said feedback control amount for every computing cycle based on a sliding mode control in which a deviation between said target air-fuel ratio and said detected air-fuel ratio is set as a switching function; and carrying out the feedback control using said computed feedback control amount, so as to approximate said detected air-fuel ratio to said target air-fuel ratio.

21. The method for controlling an air-fuel ratio of an internal combustion engine according to claim 20, wherein the computing cycle for said feedback control amount is controlled to correspond to a multiplicative value of the stroke cycle of said engine.

22. The method for controlling an air-fuel ratio of an internal combustion engine according to claim 20, wherein the computing cycle for said feedback control amount is variably controlled according to the operating conditions of said engine.

23. The method for controlling an air-fuel ratio of an internal combustion engine according to claim 20, wherein the computing cycle for said feedback control amount is variably controlled according to the deviation between said target air-fuel ratio and the actual air-fuel ratio detected by said air-fuel ratio detecting means.

24. The method for controlling an air-fuel ratio of an internal combustion engine according to claim 20, wherein the computing cycle is controlled so that said feedback control amount is computed in synchronism with a signal detecting a predetermined stroke timing of each cylinder.

25. The method for controlling an air-fuel ratio of an internal combustion engine according to claim 24, wherein said signal detecting the predetermined stroke timing of each cylinder is a reference signal output from a crank angle sensor.

26. The method for controlling an air-fuel ratio of an internal combustion engine according to claim 24, wherein said signal detecting the predetermined stroke timing of each cylinder is a signal obtained by detecting the inner-cylinder pressure.

27. A method for controlling an air-fuel ratio of an internal combustion engine, wherein an air-fuel ratio is feedback controlled so as to approximate a target air-fuel ratio set depending on engine operating conditions, said method comprising the steps of:

detecting the air-fuel ratio linearly;

compensating for a phase delay caused by a dead time element of a control object included in the detected air-fuel ratio, using a model of said control object represented by a transfer function that is switched according to the operating conditions of said engine; and computing a feedback control amount using the detected air-fuel ratio whose phase delay is compensated for, based on a sliding mode control in which a deviation between said target air-fuel ratio and the actual air-fuel ratio is set as a switching function.

28. The method for controlling an air-fuel ratio of an internal combustion engine according to claim 27, wherein said model of the control object is composed of a first element that does not include said dead time element, and a second element that represents said dead time element.

29. The method for controlling an air-fuel ratio of an internal combustion engine according to claim 28, wherein a Smith dead time compensation control compensates for the phase delay included in said detected air-fuel ratio.

30. The method for controlling an air-fuel ratio of an internal combustion engine according to claim 28, wherein in the transfer function representing said model of the control object, the order of the transfer function representing said first element is varied and switched.

31. The method for controlling an air-fuel ratio of an internal combustion engine according to claim 28, wherein in the transfer function representing said model of the control object, the time constant of the transfer function representing said first element is varied and switched.

32. The method for controlling an air-fuel ratio of an internal combustion engine according to claim 28, wherein in the transfer function representing said model of the control object, the dead time of the transfer function representing said second element is varied and switched.

33. The method for controlling an air-fuel ratio of an internal combustion engine according to claim 27, wherein said transfer function is switched according to the acceleration or deceleration state of said engine.

34. The method for controlling an air-fuel ratio of an internal combustion engine according to claim 27, wherein said transfer function is switched according to the intake air quantity.

35. The method for controlling an air-fuel ratio of an internal combustion engine according to claim 27, wherein said transfer function is switched according to the wall temperature of an intake pipe.

* * * * *